US009939752B2

(12) United States Patent
Imase

(10) Patent No.: US 9,939,752 B2
(45) Date of Patent: Apr. 10, 2018

(54) SEMICONDUCTIVE ROLLER, AND METHOD OF PRODUCING THE SAME

(71) Applicant: SUMITOMO RUBBER INDUSTRIES, LTD., Kobe-shi, Hyogo (JP)

(72) Inventor: Yuta Imase, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/356,279

(22) Filed: Nov. 18, 2016

(65) Prior Publication Data

US 2017/0160665 A1 Jun. 8, 2017

(30) Foreign Application Priority Data

Dec. 3, 2015 (JP) ..... 2015-236638
Apr. 4, 2016 (JP) ..... 2016-075333

(51) Int. Cl.
*G03G 15/02* (2006.01)

(52) U.S. Cl.
CPC . *G03G 15/0233* (2013.01); *G03G 2215/2051* (2013.01); *G03G 2215/2061* (2013.01); *G03G 2215/2064* (2013.01)

(58) Field of Classification Search
CPC ..... G03G 15/0233; G03G 2215/2051; G03G 2215/2061; G03G 2215/2064
See application file for complete search history.

(56) References Cited

U.S. PATENT DOCUMENTS 6,377,777 B1 * 4/2002 Kishino ..... G03G 15/2053 399/329
2002/0086125 A1 * 7/2002 Kakii ..... G03G 15/0233 428/36.91
2006/0147229 A1 * 7/2006 Ishida ..... G03G 15/0233 399/286

FOREIGN PATENT DOCUMENTS

JP 2006-243374 A 9/2006
JP 2006-243375 A 9/2006
JP 2008-116869 A 5/2008
JP 4613641 B2 1/2011

* cited by examiner

*Primary Examiner* — Rodney Bonnette
(74) *Attorney, Agent, or Firm* — Birch, Stewart, Kolasch & Birch, LLP

(57) ABSTRACT

A semiconductive roller is provided, which includes a tubular main body having a multiplicity of concavities (2) provided in an outer peripheral surface (1) thereof in at least one of circumferentially overlapping relation and axially overlapping relation. The concavities are each gently concave toward a center thereof from an outer periphery thereof. A semiconductive roller production method is also provided, which includes the step of forming the concavities by a laser processing method.

15 Claims, 13 Drawing Sheets

SEMICONDUCTIVE ROLLER, AND METHOD OF PRODUCING THE SAME

TECHNICAL FIELD

The present invention relates to a semiconductive roller to be used as a charging roller or the like in an electrophotographic image forming apparatus, and to a method of producing the same.

BACKGROUND ART

A lot of semiconductive rollers are incorporated in an image forming apparatus. More specifically, semiconductive rollers each produced by forming a semiconductive rubber composition into a roller shape and crosslinking the rubber composition are generally used as a charging roller for uniformly electrically charging a surface of a photoreceptor body, as a developing roller for developing an electrostatic latent image formed by light-exposing the electrically charged photoreceptor surface into a toner image, as a transfer roller for transferring the formed toner image onto a paper sheet or the like, and as a cleaning roller for removing toner from the photoreceptor surface after the transfer of the toner image to the sheet.

Such a semiconductive roller is used with a shaft of a metal or the like inserted through and fixed to a center through-hole of the roller.

The rubber composition as a material for the semiconductive roller is generally imparted with ion conductivity by blending an ion conductive rubber such as an epichlorohydrin rubber as a rubber component, or imparted with electron conductivity by blending an electrically conductive carbon black or the like.

Further, it is a general practice to use a diene rubber in combination with the ion conductive rubber as the rubber component for the rubber composition to improve the mechanical strength and the durability of the semiconductive roller and to impart the semiconductive roller with rubber characteristic properties, i.e., to make the semiconductive roller flexible and less susceptible to permanent compressive deformation with a reduced compression set.

Incidentally, minute particles such as of silica and titanium oxide are externally added as external additives to a toner for use in the image forming apparatus in order to control the fluidity, the chargeability and other characteristic properties of the toner.

However, these external additives and finely broken toner particles occurring when image formation is repeated (hereinafter referred to simply as "external additives") cannot be perfectly removed from the photoreceptor surface by means of a cleaning blade and the like. It is known that, as the image formation is repeated, the external additives left unremoved are liable to adhere to an outer peripheral surface of the semiconductive roller incorporated in the image forming apparatus, particularly to an outer peripheral surface of a charging roller constantly kept in contact with the photoreceptor surface, to be thereby gradually accumulated on the roller.

The external additives accumulated on the semiconductive roller are liable to influence the photoreceptor chargeability or to adhere to a formed image to cause an image defect.

Particularly, where the semiconductive roller is produced by forming the semiconductive rubber composition into a tubular body, crosslinking the tubular body and polishing an outer peripheral surface of the tubular body to a predetermined surface roughness, the outer peripheral surface has minute undulated polishing marks. When the image formation is repeated, the external additives are liable to adhere to and accumulated in the polishing marks, thereby causing the aforementioned problems.

In order to suppress the adhesion of the external additives, it is conceivable to coat the outer peripheral surface of the semiconductive roller with a coating film such as of a urethane resin to improve the slipperiness of the outer peripheral surface with respect to the toner and the external additives.

However, the coating film is generally formed by applying a coating agent onto the outer peripheral surface of the semiconductive roller by a spraying method, a dipping method or the like and then drying the applied coating agent. Therefore, the coating film is liable to suffer from contamination with dust and other foreign matter during the formation thereof, thickness unevenness and other defects.

With the aforementioned defects, the semiconductive roller serving as the charging roller fails to uniformly electrically charge the surface of the photoreceptor body, thereby causing an image defect such as image density unevenness.

For preparation of the coating agent, an organic solvent is required. The use of the organic solvent may exert a great load on the environment, and go against a recent trend toward reduction of VOC (volatile organic compounds).

It is also contemplated to form a multiplicity of independent concavities each having a significantly greater size than the polishing marks in the outer peripheral surface of the semiconductive roller, for example, by a laser processing, rather than forming the coating film (see, for example, Patent Documents 1 to 3).

In this case, the minute polishing marks are removed by the formation of the concavities. Further, the surface roughness and the electrical properties of the outer peripheral surface are made uniform, and the contact area and the contact pressure of the outer peripheral surface with respect to the surface of the photoreceptor body for the image formation can be controlled by arraying the multiplicity of concavities in the outer peripheral surface. Thus, it is expected to alleviate stresses on the outer peripheral surface and the toner during the image formation, thereby suppressing the adhesion and the accumulation of the external additives and the associated problems.

CITATION LIST

Patent Document

[PATENT DOCUMENT 1] JP-2008-116869A
[PATENT DOCUMENT 2] JP-2006-243374A
[PATENT DOCUMENT 3] JP-2006-243375A

SUMMARY OF INVENTION

Technical Problem

According to studies conducted on Patent Documents 1 to 3 by the inventor of the present invention, the multiplicity of concavities are spaced from each other with peripheries thereof in non-overlapping relation and, therefore, polishing marks are left unprocessed in an inter-concavity region. Accordingly, interior surfaces of the concavities and the inter-concavity region are liable to have different surface textures. Further, sharp edges are present along boundaries between the peripheries of the concavities and the unprocessed region.

The external additives are liable to adhere to and accumulate on the polishing marks left in the unprocessed inter-concavity region and the edges present along the peripheries of the concavities. Therefore, the adhesion and the accumulation of the external additives and the associated problems cannot be sufficiently suppressed.

It is an object of the present invention to provide a semiconductive roller which is capable of advantageously suppressing the adhesion and the accumulation of the external additives and the associated problems without the provision of the coating film, for example, when being used as a charging roller, and to provide a method of producing the semiconductive roller.

Solution to Problem

According to an inventive aspect, there is provided a semiconductive roller, which includes a tubular main body formed of a semiconductive rubber composition, wherein the main body has a multiplicity of concavities provided in an outer peripheral surface thereof in at least one of circumferentially overlapping relation and axially overlapping relation, wherein the concavities are each gently concave toward a center thereof from an outer periphery thereof.

According to another inventive aspect, there is provided a semiconductive roller production method, which includes the steps of forming a tubular main body of a semiconductive rubber composition, and forming a multiplicity of concavities in an outer peripheral surface of the tubular main body in at least one of circumferentially overlapping relation and axially overlapping relation by a laser processing method.

Effects of Invention

According to the present invention, the semiconductive roller is capable of advantageously suppressing the adhesion and the accumulation of the external additives and the associated problems without the provision of the coating film, for example, when being used as a charging roller. The method of producing the semiconductive roller is also provided.

DESCRIPTION OF EMBODIMENTS

The present invention provides a semiconductive roller, which includes a tubular main body formed of a semiconductive rubber composition, wherein the main body has a multiplicity of concavities provided in an outer peripheral surface thereof in at least one of circumferentially overlapping relation and axially overlapping relation, wherein the concavities are each gently concave toward a center thereof from an outer periphery thereof.

The present invention further provides a semiconductive roller production method, which includes the steps of forming a tubular main body of a semiconductive rubber composition, and forming a multiplicity of concavities in an outer peripheral surface of the tubular main body in at least one of circumferentially overlapping relation and axially overlapping relation by a laser processing method.

According to the present invention, the multiplicity of concavities are provided in the outer peripheral surface of the semiconductive roller (tubular main body) in at least one of circumferentially overlapping relation and axially overlapping relation, whereby an inter-concavity unprocessed region and peripheral edges of the concavities can be minimized.

This improves the slipperiness of the outer peripheral surface without the provision of the coating film, and advantageously suppresses the adhesion and the accumulation of the external additives and the associated problems.

In the laser processing method, the semiconductive rubber composition present in the outer peripheral surface is selectively fused by heat generated by irradiation with a laser beam narrowed to a spot shape corresponding to the contour of the concavity and at least partly evaporated for the formation of the concavities. This makes it possible to remove the polishing marks present in the inter-concavity region and to connect interior surfaces of adjacent concavities with a smoothly curved continuous surface without formation of edges.

Since the multiplicity of concavities are formed in adjoining relation so as to partly overlap each other by the laser processing, the semiconductive rubber composition present in the inter-concavity region can also be melted by heat conducted from the concavities during the formation of the concavities.

This further improves the slipperiness of the outer peripheral surface, thereby further advantageously suppressing the adhesion and the accumulation of the external additives and the associated problems.

<<Exemplary Concavity Arrangement (1) in Outer Peripheral Surface>>

Figure 1:
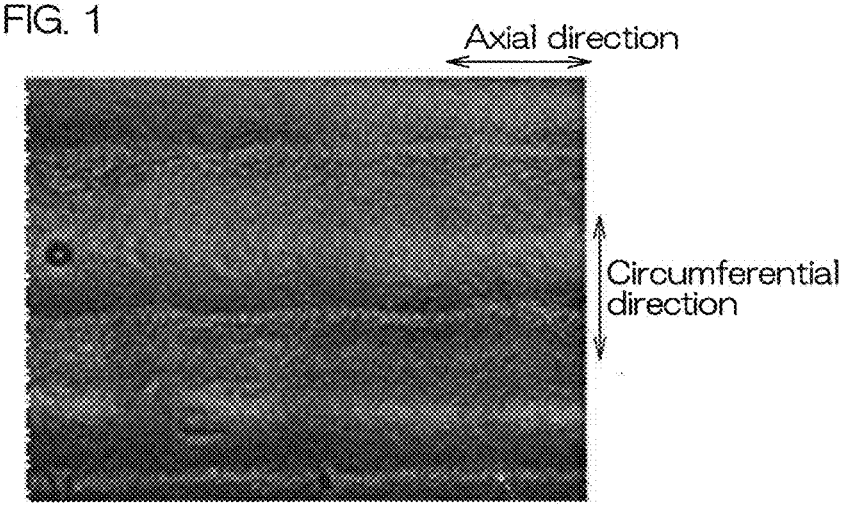
FIG. 1 is an actual microscopic photograph showing a part of an outer peripheral surface of a semiconductive roller according to one embodiment of the present invention on an enlarged scale.
Figure 2A:
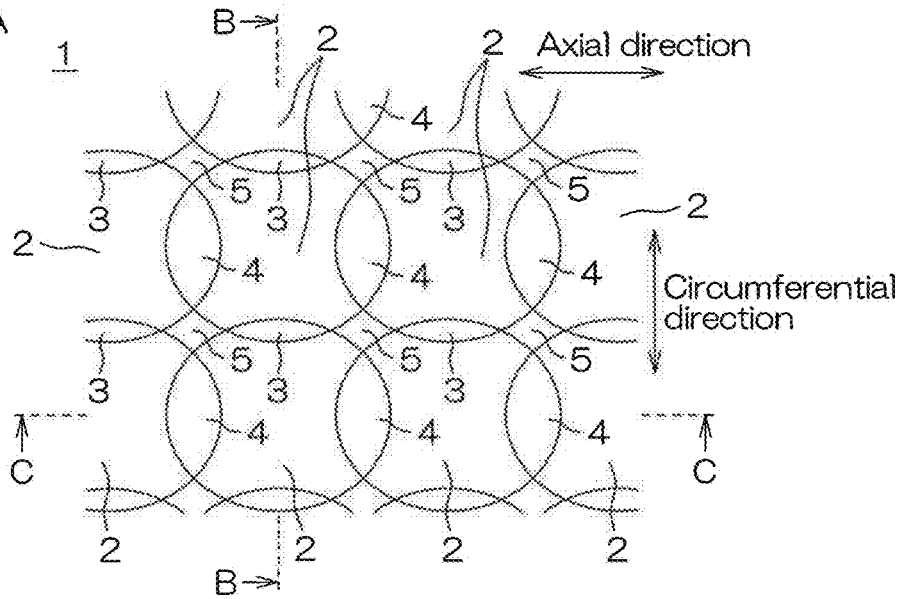
FIG. 2A is a diagram for explaining the arrangement of concavities in the outer peripheral surface shown in FIG. 1, and FIGS. 2B and 2C are sectional views taken along a line B-B and a line C-C, respectively, in FIG. 2A.
Figure 2B:
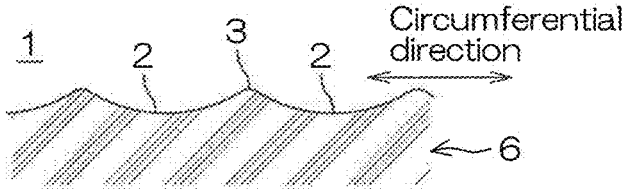
Figure 2C:
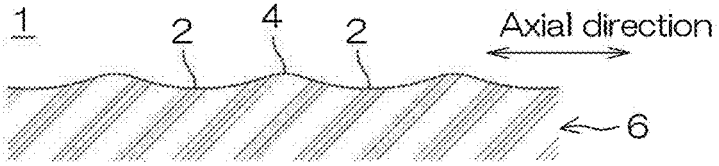

FIG. 1 is an actual microscopic photograph showing a part of an outer peripheral surface of a semiconductive roller according to one embodiment of the present invention on an enlarged scale. FIG. 2A is a diagram for explaining the arrangement of concavities 2 in the outer peripheral surface shown in FIG. 1, and FIGS. 2B and 2C are sectional views taken along a line B-B and a line C-C, respectively, in FIG. 2A.

Referring to FIGS. 1 and 2A, a multiplicity of concavities 2 each having an oval contour as seen in plan (as indicated by solid lines in FIG. 2A) are provided in the outer peripheral surface 1 of the semiconductive roller. The concavities 2 are each gently concave toward a center thereof from an outer periphery thereof.

For formation of the concavities 2 in the outer peripheral surface 1 of the semiconductive roller, for example, the outer peripheral surface 1 of the semiconductive roller is irradiated with a laser beam narrowed to an oval spot shape conformal to the contour of the concavity 2, whereby a semiconductive rubber composition or a thermoplastic elastomer present in the outer peripheral surface 1 is selectively fused and at least partly evaporated.

The concavities 2 are arranged in a matrix array circumferentially and axially of the outer peripheral surface 1 in circumferentially and axially overlapping relation.

The concavities 2 have substantially the same size. The concavities circumferentially overlap each other with a smaller overlapping amount, and axially overlap each other with a greater overlapping amount. Thus, projections 3 defined between concavities 2 located in circumferentially adjoining relation project to a greater height than projections 4 defined between concavities 2 located in axially adjoining relation (FIGS. 2B and 2C).

Therefore, the projections 3 each having a greater height are connected to one another to define projection lines which axially extend in parallel relation, and the projections 4 each having a smaller height are connected to one another to define projection lines which circumferentially extend in parallel relation and connect the projection lines defined by the projections 3. Projections 5 each having a greater height than the projections 4 and the projections 3 are present at intersections of the projection lines outside the contours of the concavities 2.

The semiconductive rubber composition and the like are fused by heat generated by the irradiation with the laser beam, whereby the polishing marks on the outer peripheral surface 1 are removed and the concavities 2 are connected together to be smoothly and continuously curved without formation of edges along boundaries between the concavities 2 and the projections 3 to 5.

Since the concavities 2 are arranged in the matrix array circumferentially and axially of the outer peripheral surface 1, the process setting and the processing operation can be easily performed with a proper processing accuracy, and the resulting outer peripheral surface 1 has a uniform surface texture.

Since the semiconductive roller is driven to be rotated with its outer peripheral surface 1 in an axially uniformly contacting state, the concavities 2 arranged in the matrix array are supposedly more effective than concavities 2 arranged at random. This is also true in the case of other exemplary concavity arrangements.

The dimensions of the respective portions of the outer peripheral surface 1 are not particularly limited, but the concavities 2 preferably each have a depth of not less than 0.5 μm and not greater than 100 μm, more preferably not greater than 50 μm, particularly preferably not less than 1 μm and not greater than 30 μm.

If the depth of the concavities 2 is less than the aforementioned range, smaller undulations are formed in the outer peripheral surface 1, making it impossible to sufficiently provide the effect of the formation of the multiplicity of concavities 2 in the outer peripheral surface 1 and to sufficiently suppress the adhesion and the accumulation of the external additives and the associated problems.

If the depth of the concavities 2 is greater than the aforementioned range, excessively great undulations are formed in the outer peripheral surface 1, making it impossible to uniformly and sufficiently electrically charge the surface of the photoreceptor body, for example, when being used as a charging roller. Therefore, an image defect is liable to occur due to charging failure.

In the present invention, the depth of the concavities 2 is defined as a height difference between the highest point of the outer peripheral surface 1 (i.e., the highest point of the projections 5) and the lowest point of the concavities 2.

The definitions of the concavities 2 and the projections 3 to 5 are herein such that regions each having a load area ratio of greater than 10% on a volume parameter graph (load curve) specified in International Organization for Standardization ISO 25178-2:2012 "Geometrical product specifications (GPS)—Surface texture: Areal-Part 2: Terms, definitions and surface texture parameters" are defined as the concavities 2, and regions each having a load area ratio of not greater than 10% are defined as projections 3 to 5.

The outer peripheral surface 1 is preferably such that where the maximum height Sz specified in ISO 25178-2:

2012 is not less than 0.5 μm and not greater than 30 μm, the developed interfacial area ratio Sdr specified in ISO 25178-2:2012 is not greater than 5.

The developed interfacial area ratio Sdr is an index that indicates the increment of the developed area (surface area) of the definition region with respect to the area of the definition region (e.g., 50000 $\mu m^2$). In the case of a perfectly flat surface, the developed surface area ratio Sdr is 0.

Where the developed area ratio Sdr is not greater than 5, the adjacent concavities 2 and the projections 3 to 5 defined between the adjacent concavities 2 are connected together to be smoothly and continuously curved. Thus, the outer peripheral surface 1 is improved in slipperiness with respect to the toner and the external additives.

For further improvement of the aforementioned effect, the developed area ratio Sdr is more preferably not less than 0.5 and not greater than 3 within the aforementioned range.

However, if the area of the definition region and the maximum height Sz are different, the developed area ratio Sdr is not limited to the aforementioned range.

<<Exemplary Concavity Arrangement (2) in Outer Peripheral Surface>>

Figure 3:
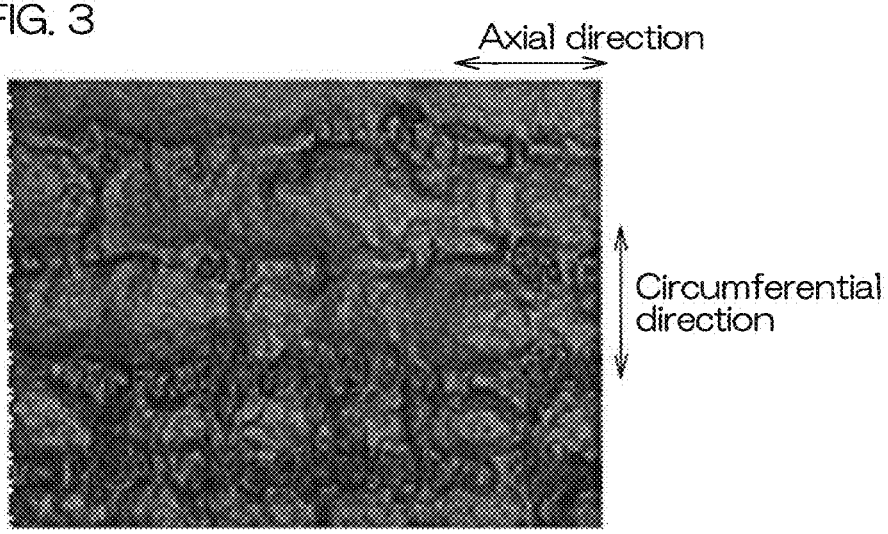
FIG. 3 is an actual microscopic photograph showing a part of an outer peripheral surface of a semiconductive roller according to another embodiment of the present invention on an enlarged scale.
Figure 4:
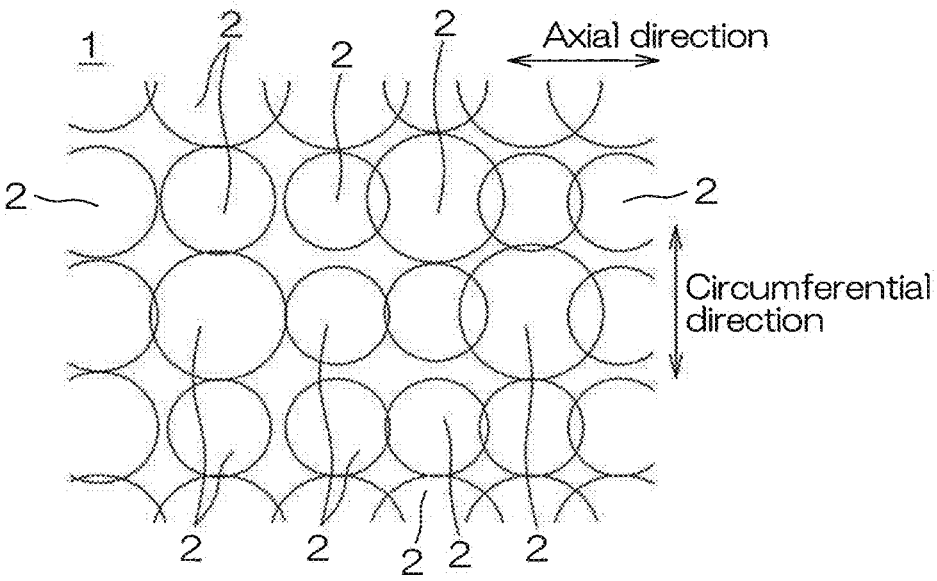
FIG. 4 is a diagram for explaining the arrangement of concavities in the outer peripheral surface shown in FIG. 3.

FIG. 3 is an actual microscopic photograph showing a part of an outer peripheral surface of a semiconductive roller according to another embodiment of the present invention on an enlarged scale, and FIG. 4 is a diagram for explaining the arrangement of concavities 2 in the outer peripheral surface shown in FIG. 3.

Referring to FIGS. 3 and 4, concavities 2 having oval contours as seen in plan and randomly different sizes as indicated by solid lines in FIG. 4 are arranged circumferentially and axially of the outer peripheral surface 1.

Since the concavities 2 have randomly different sizes, adjacent concavities 2 overlap each other with different overlapping amounts. In the outer peripheral surface 1, projections and projection lines extending circumferentially and/or axially are defined by overlapping portions of the concavities 2 and regions outside the contours of the concavities 2.

A semiconductive rubber composition present in the outer peripheral surface 1 is fused by heat generated by the irradiation with the laser beam, whereby the polishing marks on the outer peripheral surface 1 are removed, and the concavities 2 are connected together to be smoothly and continuously curved without formation of edges along boundaries between the concavities 2 and the projections or the projection lines.

<<Exemplary Concavity Arrangement (3) in Outer Peripheral Surface>>

Figure 5:
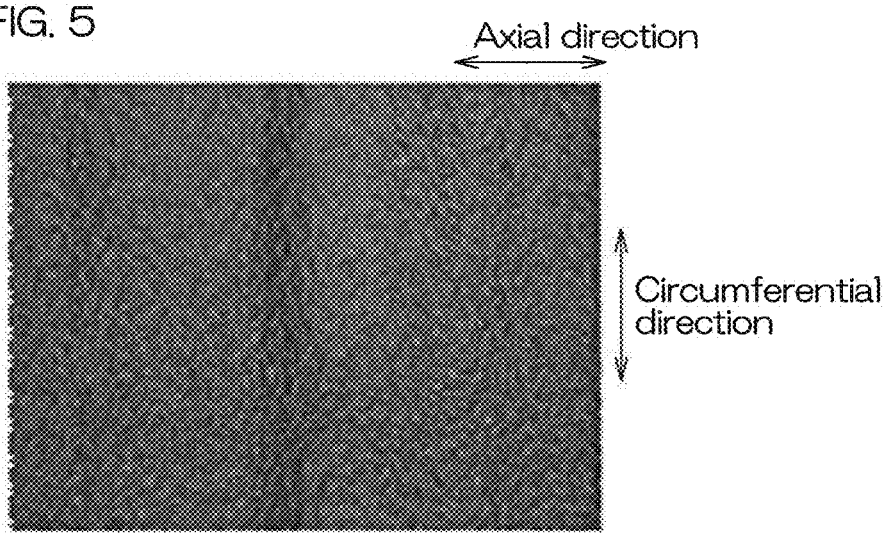
FIG. 5 is an actual microscopic photograph showing a part of an outer peripheral surface of a semiconductive roller according to further another embodiment of the present invention on an enlarged scale.
Figure 6:
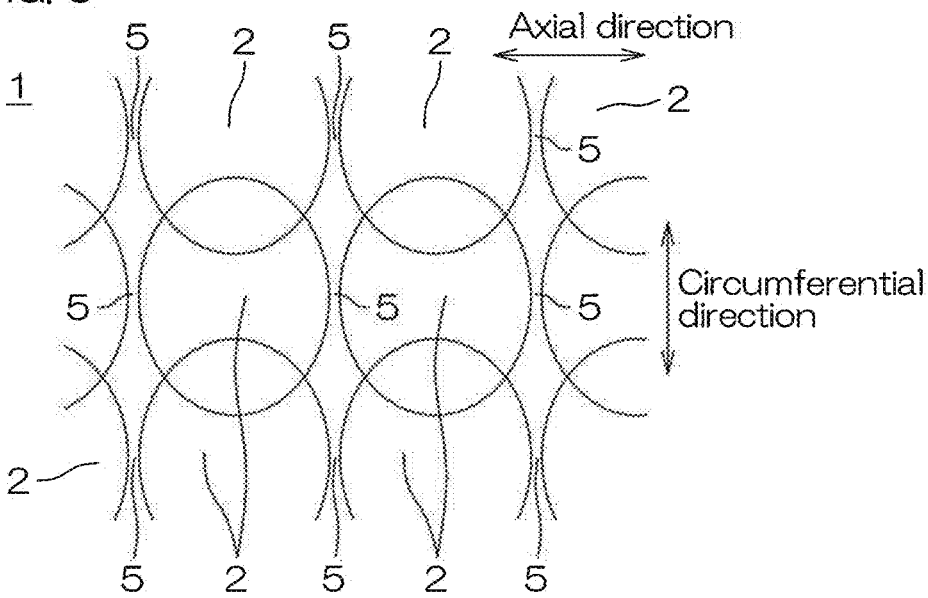
FIG. 6 is a diagram for explaining the arrangement of concavities in the outer peripheral surface shown in FIG. 5.

FIG. 5 is an actual microscopic photograph showing a part of an outer peripheral surface of a semiconductive roller according to further another embodiment of the present invention on an enlarged scale, and FIG. 6 is a diagram for explaining the arrangement of concavities 2 in the outer peripheral surface shown in FIG. 5.

Referring to FIGS. 5 and 6, concavities 2 having oval contours having the same size are arranged circumferentially in significantly overlapping relation and axially in non-overlapping relation as indicated by solid lines in FIG. 6. Thus, projections 5 each defined between axially adjoining concavities 2 are circumferentially connected to each other to define projection lines.

A semiconductive rubber composition present in the outer peripheral surface 1 is fused by heat generated by the irradiation with the laser beam, whereby the polishing marks on the outer peripheral surface 1 are removed, and the concavities 2 and the projection lines are connected together to be smoothly and continuously curved without formation of edges.

<<Exemplary Concavity Arrangement (4) in Outer Peripheral Surface>>

Figure 7:
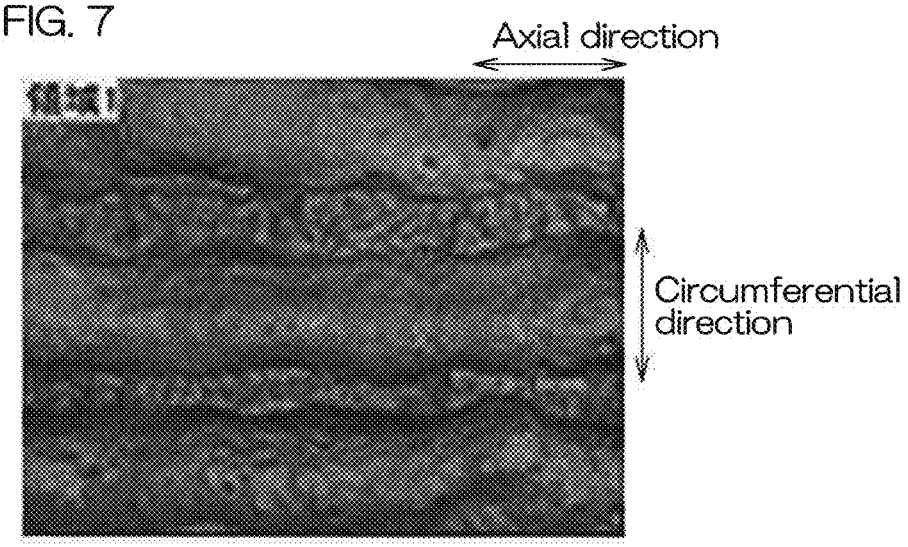
FIG. 7 is an actual microscopic photograph showing a part of an outer peripheral surface of a semiconductive roller according to still another embodiment of the present invention on an enlarged scale.
Figure 8:
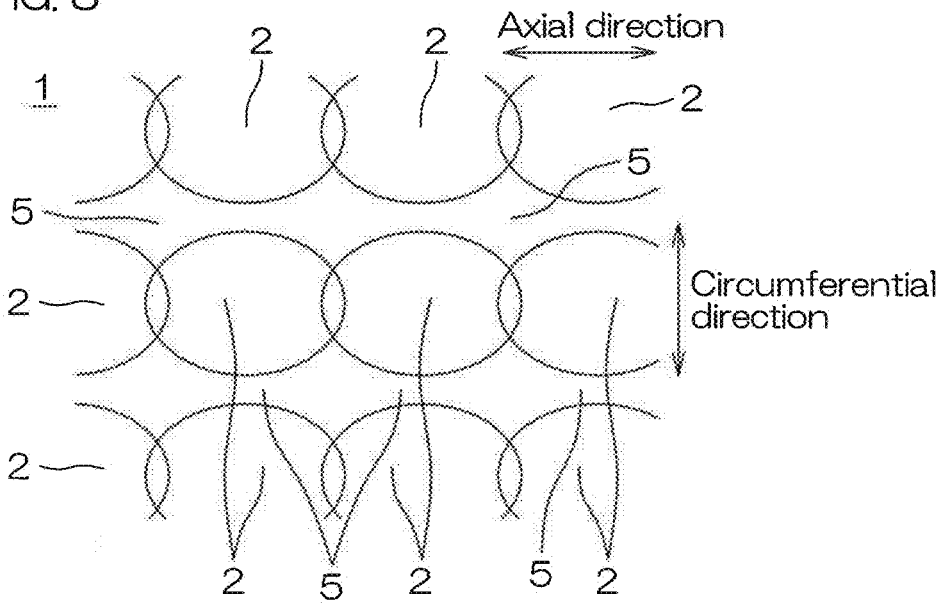
FIG. 8 is a diagram for explaining the arrangement of concavities in the outer peripheral surface shown in FIG. 7.

FIG. 7 is an actual microscopic photograph showing a part of an outer peripheral surface of a semiconductive roller according to still another embodiment of the present invention on an enlarged scale, and FIG. 8 is a diagram for explaining the arrangement of concavities 2 in the outer peripheral surface shown in FIG. 7.

Referring to FIGS. 7 and 8, concavities 2 having oval contours having the same size are arranged axially in overlapping relation and circumferentially in non-overlapping spaced relation as indicated by solid lines in FIG. 8.

As a result, regions each defined between adjacent rows of axially aligning concavities 2 axially extend in parallel relation and are left unprocessed with polishing marks remaining therein. Further, edges are defined along boundaries between the rows of axially aligning concavities 2 and the unprocessed regions 5.

With this arrangement, the other regions of the outer peripheral surface 1 are connected together to be smoothly and continuously curved, making it possible to suppress the adhesion and the accumulation of the external additives on the outer peripheral surface 1 and the associated problems. However, as apparent from the results for inventive examples to be described later, the unprocessed regions 5 and the edges are preferably obviated for further improvement of the aforementioned effect. Preferably, the outer peripheral surface 1 is entirely a continuously curved surface as shown in FIG. 1 and the like.

In the exemplary concavity arrangements shown in FIGS. 3, 5 and 7, the concavities 2 preferably each have a size satisfying the aforementioned requirement, i.e., have a depth of not less than 0.5 μm and not greater than 100 μm.

Where the outer peripheral surface 1 has a maximum height Sz of not less than 0.5 μm and not greater than 30 μm, the developed interfacial area ratio Sdr is preferably not greater than 5. However, this is not always true for the aforementioned reason, if the area of the definition region and the maximum height Sz are different.

<<Exemplary Concavity Arrangement (5) in Outer Peripheral Surface>>

Figure 9:
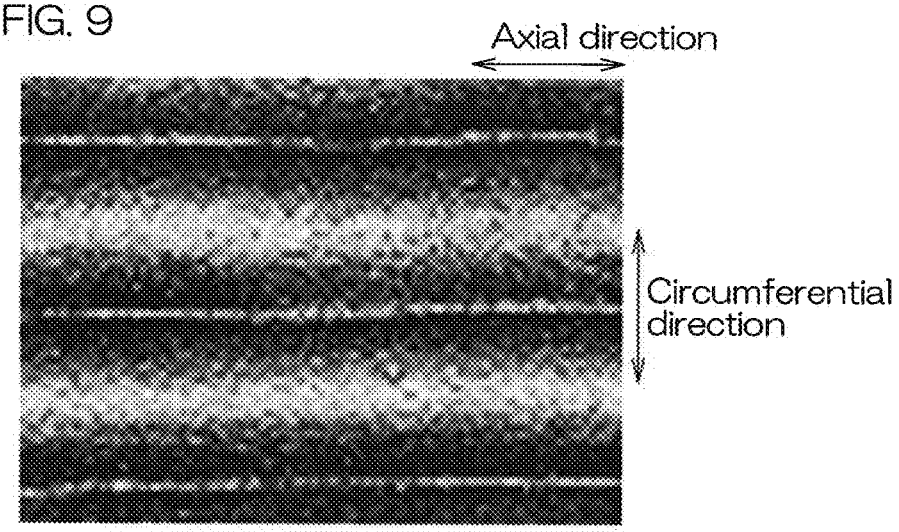
FIG. 9 is an actual microscopic photograph showing a part of an outer peripheral surface of a semiconductive roller according to further another embodiment of the present invention on an enlarged scale.
Figure 10:
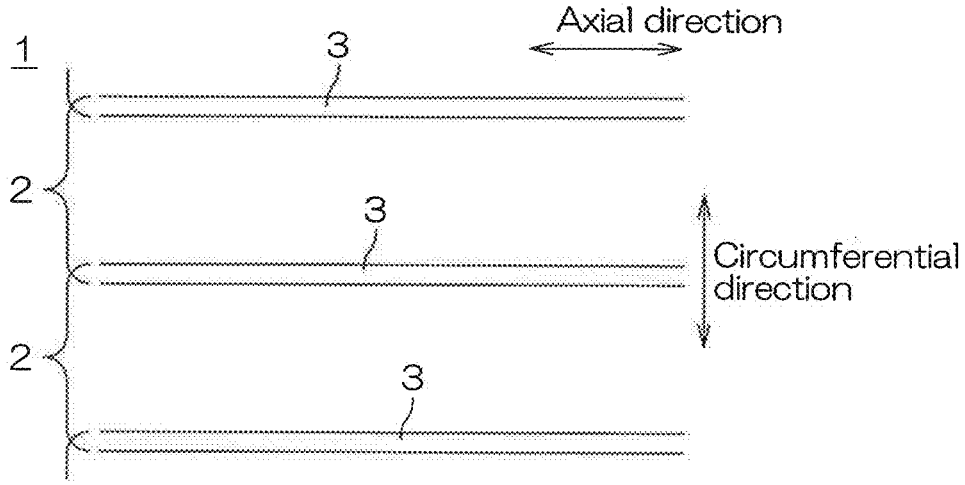
FIG. 10 is a diagram for explaining the arrangement of concavities in the outer peripheral surface shown in FIG. 9.

FIG. 9 is an actual microscopic photograph showing a part of an outer peripheral surface of a semiconductive roller according to further another embodiment of the present invention on an enlarged scale, and FIG. 10 is a diagram for explaining the arrangement of concavities 2 in the outer peripheral surface shown in FIG. 9.

Referring to FIGS. 9 and 10, a plurality of linear concavities 2 each extending axially along the entire length of the semiconductive roller are arranged in circumferentially parallel relation as indicated by solid lines in FIG. 10.

For formation of the concavities 2, for example, the outer peripheral surface 1 of the semiconductive roller is scanned axially of the semiconductive roller with a laser beam having a predetermined width corresponding to the width of the concavities 2 to be irradiated with the laser beam. Thus, a semiconductive rubber composition or a thermoplastic elastomer present in the outer peripheral surface 1 is selectively fused and at least partly evaporated, whereby the concavities 2 are formed in the outer peripheral surface 1.

Circumferentially adjoining concavities 2 overlap each other along opposite side edges thereof, so that projection lines 3 are defined between the circumferentially adjoining concavities 2 as extending continuously axially.

In the outer peripheral surface 1, the semiconductive rubber composition is fused by heat generated by the irradiation with the laser beam, whereby the polishing marks are removed, and the concavities 2 and the projection lines 3 are connected together to be smoothly and continuously curved without edges.

<<Exemplary Concavity Arrangement (6) in Outer Peripheral Surface>>

Figure 11:
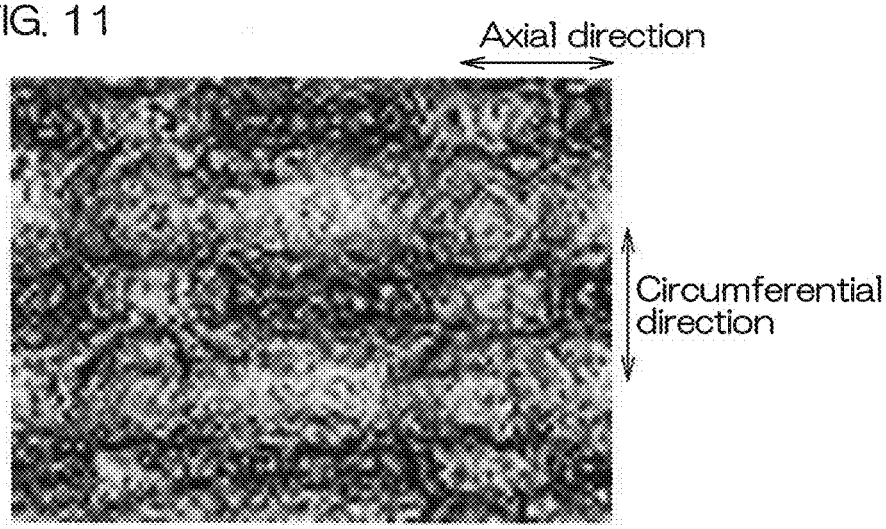
FIG. 11 is an actual microscopic photograph showing a part of an outer peripheral surface of a semiconductive roller according to still another embodiment of the present invention on an enlarged scale.
Figure 12:
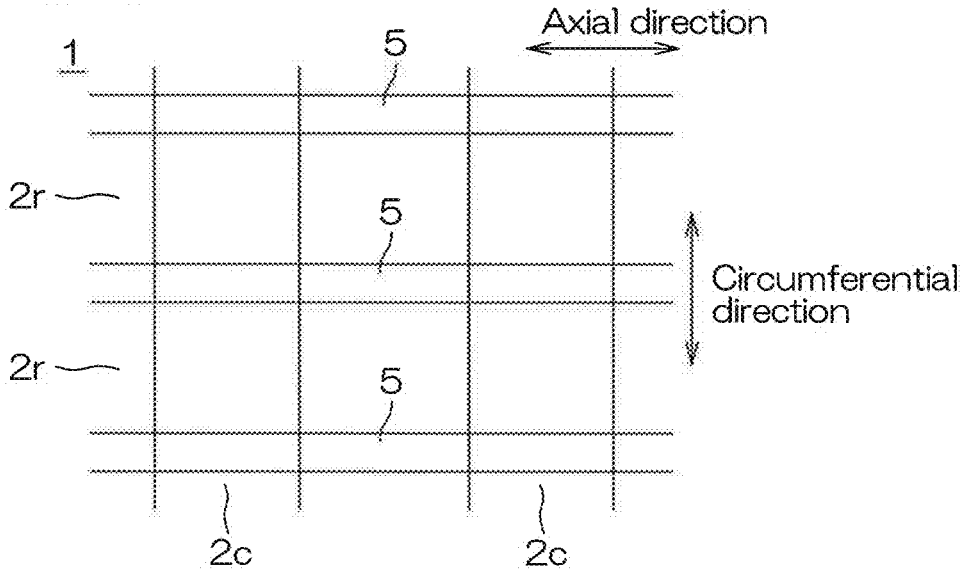
FIG. 12 is a diagram for explaining the arrangement of concavities in the outer peripheral surface shown in FIG. 11.

FIG. 11 is an actual microscopic photograph showing a part of an outer peripheral surface of a semiconductive roller according to still another embodiment of the present invention on an enlarged scale, and FIG. 12 is a diagram for explaining the arrangement of concavities 2 in the outer peripheral surface shown in FIG. 11.

Referring to FIGS. 11 and 12, a plurality of linear concavities 2*r* axially extending in parallel relation are arranged over the entire circumference of the semiconductive roller as indicated by solid lines in FIG. 12.

Further, a plurality of linear concavities 2*c* circumferentially extending in parallel relation are arranged over the entire length of the semiconductive roller.

For formation of the concavities 2*r*, 2*c*, for example, the outer peripheral surface 1 of the semiconductive roller is scanned axially of the semiconductive roller with a laser beam having a predetermined width to be irradiated with the laser beam, and then scanned circumferentially of the semiconductive roller with a laser beam having a predetermined width to be irradiated with the laser beam. Thus, a semiconductive rubber composition or a thermoplastic elastomer present in the outer peripheral surface 1 is selectively fused and at least partly evaporated, whereby the concavities 2*r*, 2*c* are formed in the outer peripheral surface 1.

The circumferentially extending concavities 2*c* are arranged in axially non-overlapping spaced relation, and the axially extending concavities 2*r* are arranged in circumferentially non-overlapping spaced relation. The concavities 2*c*, 2*r* define a circumferentially and axially extending lattice.

The pitch of the concavities 2*c* is greater than the pitch of the concavities 2*r*, whereby axially elongated rectangular regions 5 are defined between the concavities 2*r*. These regions 5 are left unprocessed with the polishing marks remaining therein. Edges are present along boundaries between the regions 5 and the concavities 2*r*.

In other regions of the outer peripheral surface 1, the semiconductive rubber composition is fused by heat generated by the irradiation with the laser beam, whereby the polishing marks are removed and the concavities 2*c*, 2*r* are connected together with smoothly curved surfaces. This makes it possible to suppress the adhesion and the accumulation of the external additives on the outer peripheral surface 1 and the associated problems.

<<Exemplary Concavity Arrangement (7) in Outer Peripheral Surface>>

Figure 13:
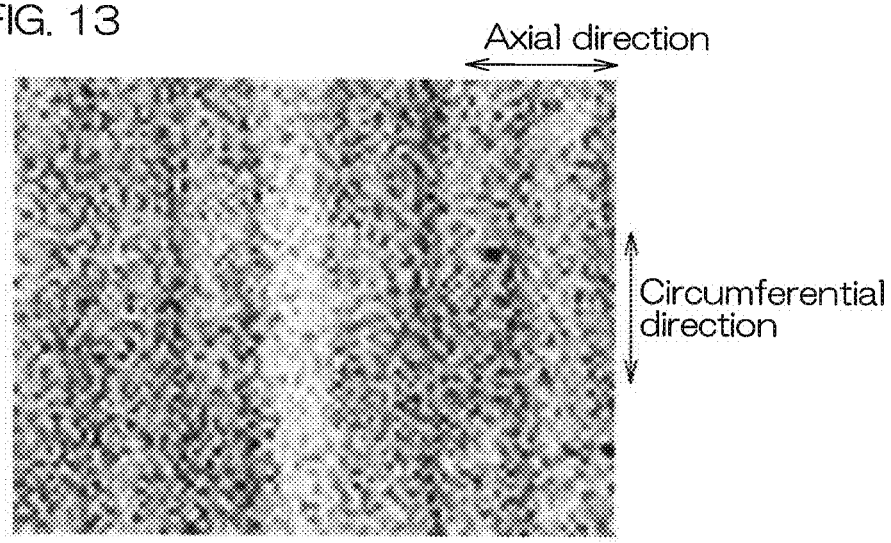
FIG. 13 is an actual microscopic photograph showing a part of an outer peripheral surface of a semiconductive roller according to further another embodiment of the present invention on an enlarged scale.
Figure 14:
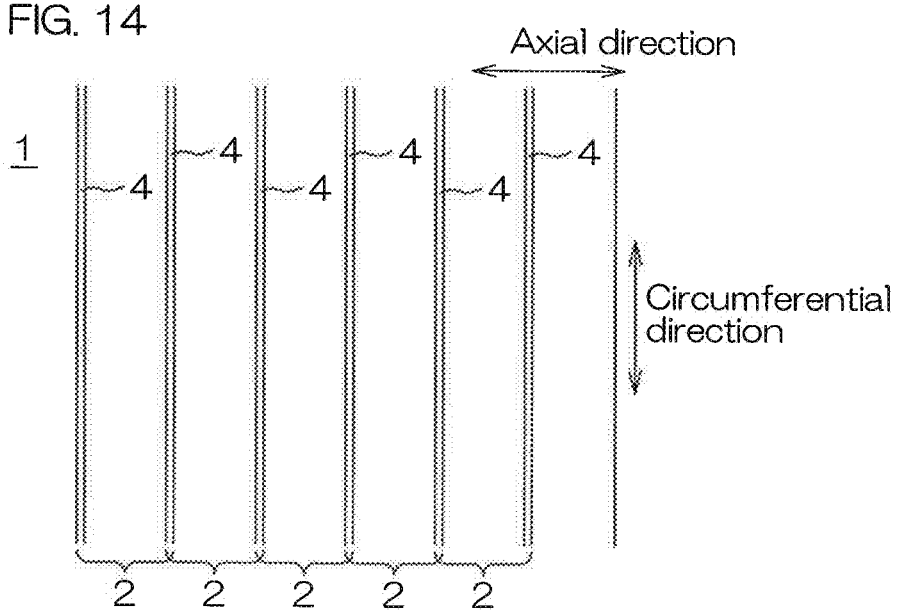
FIG. 14 is a diagram for explaining the arrangement of concavities in the outer peripheral surface shown in FIG. 13.

FIG. 13 is an actual microscopic photograph showing a part of an outer peripheral surface of a semiconductive roller according to further another embodiment of the present invention on an enlarged scale, and FIG. 14 is a diagram for explaining the arrangement of concavities 2 in the outer peripheral surface shown in FIG. 13.

Referring to FIGS. 13 and 14, a plurality of linear concavities 2 each extending circumferentially of the semiconductive roller are arranged in axially parallel relation as indicated by solid lines in FIG. 14.

For formation of the concavities 2, the outer peripheral surface 1 of the semiconductive roller is irradiated with laser beams each having a predetermined width corresponding to the width of the concavities 2, while the semiconductive roller is rotated. Thus, a semiconductive rubber composition or a thermoplastic elastomer present in the outer peripheral surface 1 is selectively fused, and at least partly evaporated, whereby the concavities 2 are formed Axially adjoining concavities 2 overlap each other along opposite side edges thereof, and projection lines 4 are defined between the adjoining concavities 2 as extending circumferentially.

The semiconductive rubber composition present in the outer peripheral surface 1 is fused by heat generated by the irradiation with the laser beams, whereby the polishing marks are removed and the concavities 2 and the projection lines 4 are connected together to be smoothly and continuously curved without edges.

Where the linear concavities 2 are formed as shown in FIGS. 9, 11 and 13, the number of times of the irradiation with the laser beam and the irradiation period can be easily controlled, thereby advantageously improving the productivity of the semiconductive roller.

In the exemplary concavity arrangements shown in FIGS. 9, 11 and 13, the concavities 2 preferably satisfy the aforementioned size requirement. That is, the concavities 2 preferably each have a depth of not less than 0.5 μm and not greater than 100 μm.

Where the outer peripheral surface 1 has a maximum height Sz of not less than 0.5 μm and not greater than 30 μm, the developed interfacial area ratio Sdr is preferably not greater than 5. However, this is not always true for the aforementioned reason, if the area of the definition region and the maximum height Sz are different.

As apparent from the results for the inventive examples and the comparative examples to be described later, the concavities 2 preferably each have a depth of not greater than 50 μm and a width of not greater than 100 μm in the exemplary concavity arrangements shown in FIGS. 9, 11 and 13 for further suppression of the image defect attributable to the charging failure.

The concavities 2 preferably extend axially as in the exemplary concavity arrangements shown in FIGS. 9 and 11 in order to more advantageously suppress the adhesion and the accumulation of the external additives on the outer peripheral surface 1 and the associated problems.

<<Semiconductive Roller (1)>>

Figure 15:
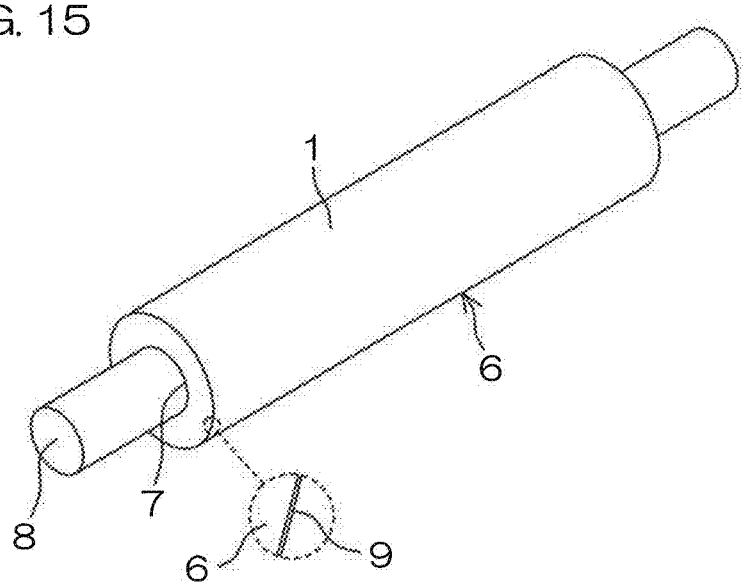
FIG. 15 is a perspective view showing the overall appearance of a semiconductive roller according to still another embodiment of the present invention.

FIG. 15 is a perspective view showing the overall appearance of a semiconductive toner having an outer peripheral surface formed with the concavities according to still another embodiment of the present invention.

Referring to FIG. 15, the semiconductive roller 6 according to this embodiment is produced by forming a semiconductive rubber composition into a nonporous single-layer tubular body, and a shaft 8 is inserted through and fixed to a center through-hole 7 of the semiconductive roller as in the conventional art.

The shaft 8 is a unitary member made of a metal such as iron, aluminum, an aluminum alloy or a stainless steel.

The shaft 8 is electrically connected to and mechanically fixed to the semiconductive roller 6, for example, via an electrically conductive adhesive agent. Alternatively, a shaft having an outer diameter that is greater than the inner diameter of the through-hole 7 is used as the shaft 8, and press-inserted into the through-hole 7 to be electrically connected to and mechanically fixed to the semiconductive roller 6. Thus, the shaft 8 and the semiconductive roller 6 are unitarily rotatable.

The semiconductive roller 6 may have an oxide film 9 formed in an outer peripheral surface 1 thereof as shown in FIG. 15 on an enlarged scale.

The oxide film 9 thus formed functions as a dielectric layer to reduce the dielectric dissipation factor of the semiconductive roller 6.

Further, the oxide film 9 serves as a lower friction layer which further advantageously suppresses the adhesion and the accumulation of the external additives when the semiconductive roller 6 is used as the charging roller.

In addition, the oxide film 9 can be easily formed, for example, by irradiating the outer peripheral surface with ultraviolet radiation in an oxidizing atmosphere. This suppresses the reduction in the productivity of the semiconductive roller 6 and the increase in the production costs of the semiconductive roller 6. However, the oxide film 9 may be obviated.

For production of the semiconductive roller 6 according to this embodiment, a predetermined semiconductive rubber composition is first extruded into a tubular shape by means of an extruder, and crosslinked in a vulcanization can by pressure and heat. Thus, a tubular body is prepared as a precursor of the semiconductive roller 6.

Then, the tubular body thus prepared is heated in an oven or the like for secondary crosslinking, then cooled, cut to a predetermined length, and polished to a predetermined outer diameter.

The shaft 8 may be inserted through and fixed to the through-hole 7 at any time between the end of the crosslinking and the end of the polishing.

However, the tubular body is preferably secondarily crosslinked and polished with the shaft 8 inserted through the through-hole 7 after the crosslinking.

This prevents warpage and deformation of the tubular body which may otherwise occur due to expansion and contraction of the tubular body in the secondary crosslinking. Further, the tubular body may be polished while being rotated about the shaft 8. This improves the working efficiency in the polishing, and suppresses deflection of the outer peripheral surface 1.

As previously described, the shaft 8 may be inserted through the through-hole 7 of the tubular body with the intervention of an electrically conductive thermosetting adhesive agent before the secondary crosslinking, or the shaft 8 having an outer diameter greater than the inner diameter of the through-hole 7 may be press-inserted into the through-hole 7.

In the former case, the thermosetting adhesive agent is cured when the tubular body is secondarily crosslinked by the heating in the oven. Thus, the shaft 8 is electrically connected to and mechanically fixed to the tubular body.

In the latter case, the electrical connection and the mechanical fixing are achieved simultaneously with the press insertion.

Subsequently, the polished outer peripheral surface 1 is scanned with a laser beam narrowed to a spot shape corresponding to the contour of a predetermined concavity 2 for irradiation of concavity formation regions thereof to be thereby formed with a multiplicity of concavities 2. Thereafter, the oxide film 9 is formed in the outer peripheral surface 1 as required. Thus, the semiconductive roller 6 according to this embodiment is produced.

As previously described, the formation of the oxide film 9 is preferably achieved by the irradiation of the outer peripheral surface 1 of the semiconductive roller 6 with the ultraviolet radiation, because this method is simple and efficient. That is, the formation of the oxide film 9 is achieved through the oxidation of the semiconductive rubber composition present in the outer peripheral surface 1 of the semiconductive roller 6 by the irradiation with ultraviolet radiation having a predetermined wavelength in the oxidizing atmosphere for a predetermined period.

Since the formation of the oxide film 9 is achieved through the oxidation of the rubber composition present in the outer peripheral surface 1 of the semiconductive roller 6 by the irradiation with the ultraviolet radiation, as described above, the resulting oxide film 9 is free from the problems associated with the conventional film formation method in which a coating film is formed by applying a coating agent, and is highly uniform in thickness and surface geometry The wavelength of the ultraviolet radiation to be used for the irradiation is preferably not less than 100 nm and not greater than 400 nm, particularly preferably not greater than 300 nm, for efficient oxidation of the semiconductive rubber composition and for the formation of the oxide film 9 excellent in the aforementioned functions. The irradiation period is preferably not shorter than 30 seconds and not longer than 30 minutes, particularly preferably not shorter than 1 minute and not longer than 20 minutes.

The oxide film 9 may be formed, for example, by an ozone exposure method or other method, or may be obviated as described above.

The semiconductive roller 6 preferably has a Shore-A hardness of not greater than 60 degrees, particularly preferably not greater than 55 degrees.

If the Shore-A hardness is greater than the aforementioned range, the semiconductive roller 6 has insufficient flexibility, thereby failing to provide a greater nip width to properly and efficiently electrically charge the photoreceptor body. Further, the semiconductive roller 6 is liable to damage the surface of the photoreceptor body.

In the present invention, the Shore-A hardness is determined at a temperature of 23±2° C. in conformity with a measurement method specified by Japanese Industrial Standards JIS K6253-3$_{:2012}$ by means of a micro rubber durometer MD-1 available from Kobunshi Keiki Co., Ltd.

Various rubber compositions that are capable of imparting the semiconductive roller 6 with a semiconductivity of, for example, not greater than about $10^8\Omega$ and permit the formation of the concavities 2 in the outer peripheral surface 1 by the laser processing method or the like are usable as the semiconductive rubber composition for the semiconductive roller 6 shown in FIG. 15.

The semiconductive rubber composition contains a rubber component including an epichlorohydrin rubber (ion conductive rubber), by way of example but not by way of limitation, to be thereby imparted with ion conductivity.

<Epichlorohydrin Rubber>

Various ion-conductive polymers each containing epichlorohydrin as a repeating unit are usable as the epichlorohydrin rubber of the rubber component.

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the roller resistance of the semiconductive roller. If the ethylene oxide content is less than the aforementioned range, however, it will be impossible to sufficiently provide this function and hence to sufficiently reduce the roller resistance.

If the ethylene oxide content is greater than the aforementioned range, on the other hand, ethylene oxide is liable to be crystallized, whereby the segment motion of molecular chains is hindered to adversely increase the roller resistance. Further, the semiconductive roller is liable to have an excessively high hardness after the crosslinking, and the semiconductive rubber composition is liable to have a higher viscosity and, hence, poorer processability when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to provide this function and hence to sufficiently reduce the roller resistance.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 15 mol % and not greater than 48 mol %.

Examples of the GECO include copolymers of the three comonomers described above in a narrow sense, as well as known modification products obtained by modifying an epichlorohydrin-ethylene oxide copolymer (ECO) with allyl glycidyl ether. Any of these modification products may be used as the GECO.

Where a diene rubber to be next described is used in combination with the epichlorohydrin rubber, the proportion of the epichlorohydrin rubber to be blended is preferably not less than 15 parts by mass and not greater than 80 parts by mass, particularly preferably not less than 50 parts by mass and not greater than 70 parts by mass, based on 100 parts by mass of the overall rubber component.

<Diene Rubber>

A diene rubber may be used in combination with the epichlorohydrin rubber as the rubber component.

The diene rubber functions to improve the mechanical strength and the durability of the semiconductive roller 6, as described above, and to impart the semiconductive roller 6 with rubber characteristic properties, i.e., to make the semiconductive roller 6 flexible and less susceptible to permanent compressive deformation with a reduced compression set.

Further, the diene rubber is mainly oxidized by the irradiation of the outer peripheral surface 1 of the semiconductive roller 6 with ultraviolet radiation to form the oxide film 9 in the outer peripheral surface 1.

Examples of the diene rubber include a styrene butadiene rubber (SBR), a chloroprene rubber (CR), an acrylonitrile butadiene rubber (NBR), a butadiene rubber (BR), a natural rubber and an isoprene rubber (IR), which may be used alone or in combination.

Among these diene rubbers, the NBR is preferably used alone, or the CR and the NBR are preferably used in combination. The latter combinational use is particularly preferred.

That is, the epichlorohydrin rubber, the CR and the NBR are preferably used in combination as the rubber component. Two or more types of different grades of each of these three rubbers may be used in combination.

Where these rubbers are used in combination, the CR, which contains a great number of chlorine atoms in its molecule, functions as the diene rubber, as well as functions to improve the charging properties of the semiconductive roller particularly when the inventive semiconductive roller is used as the charging roller. Further, the CR, which is a polar rubber, functions to finely control the roller resistance of the semiconductive roller.

The CR is synthesized by emulsion polymerization of chloroprene, and may be classified in a sulfur modification type or a non-sulfur-modification type depending on the type of a molecular weight adjusting agent to be used for the emulsion polymerization.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR may be classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent.

The xanthogen modification type CR is synthesized in substantially the same manner as the sulfur modification type CR, except that an alkyl xanthogen compound is used as the molecular weight adjusting agent.

Further, the CR may be classified in a lower crystallization speed type, an intermediate crystallization speed type or a higher crystallization speed type depending on the crystallization speed.

In the present invention, any of the aforementioned types of CRs may be used. Particularly, a CR of the non-sulfur-modification type and the lower crystallization speed type is preferred.

Further, a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

Further, the CR may be classified in an oil-extension type having flexibility controlled by addition of an extension oil or a non-oil-extension type containing no extension oil.

Where the semiconductive roller is used as the charging roller, the non-oil-extension type CR is preferably used for prevention of contamination of the photoreceptor body.

The NBR has excellent functions as the diene rubber.

The NBR may be classified in a lower acrylonitrile content type, an intermediate acrylonitrile content type, an intermediate and higher acrylonitrile content type, a higher acrylonitrile content type or a very high acrylonitrile content type depending on the acrylonitrile content. Any of these types of NBRs are usable.

Further, the NBR may be classified in an oil-extension type having flexibility controlled by addition of an extension oil or a non-oil-extension type containing no extension oil. Particularly, where the semiconductive roller is used as the charging roller, the non-oil-extension type NBR is preferably used for the prevention of the contamination of the photoreceptor body.

Where the epichlorohydrin rubber, the CR and the NBR are used in combination as the rubber component, the proportion of the CR to be blended is preferably not less than 5 parts by mass and not greater than 30 parts by mass, particularly preferably not greater than 20 parts by mass, based on 100 parts by mass of the overall rubber component.

If the proportion of the CR is less than the aforementioned range, it will be impossible to sufficiently provide the aforementioned effects of the blending of the CR, i.e., for improving the charging properties when the semiconductive roller is used as the charging roller and for finely controlling the roller resistance.

If the proportion of the CR is greater than the aforementioned range, on the other hand, the proportion of the epichlorohydrin rubber is relatively reduced, making it impossible to impart the semiconductive roller with semiconductivity sufficient for the charging roller.

The proportion of the NBR to be blended is a balance obtained by subtracting the proportions of the epichlorohydrin rubber and the CR from the total. That is, the proportion of the NBR is such that the predetermined proportions of the epichlorohydrin rubber and the CR plus the proportion of the NBR equal to 100 parts by mass of the overall rubber component.

<Crosslinking Component>

A thiourea crosslinking agent for mainly crosslinking the epichlorohydrin rubber, a sulfur crosslinking agent for crosslinking the diene rubber and the GECO of the epichlorohydrin rubber and the like, and accelerating agents for these crosslinking agents are preferably used in combination as the crosslinking component.

(Thiourea Crosslinking Agent and Accelerating Agent)

Various compounds each having a thiourea group in a molecule thereof and functioning as a crosslinking agent for the epichlorohydrin rubber are usable as the thiourea crosslinking agent.

Examples of the thiourea crosslinking agent include tetramethylthiourea, trimethylthiourea, ethylene thiourea (also referred to as 2-mercaptoimidazoline) and thioureas represented by $(C_nH_{2n+1}NH)_2C{=}S$ (wherein n is a number of 1 to 10). These thiourea crosslinking agents may be used alone or in combination. Particularly, ethylene thiourea is preferred.

The proportion of the thiourea crosslinking agent to be blended is preferably not less than 0.3 parts by mass and not greater than 1 part by mass based on 100 parts by mass of the overall rubber component.

Examples of the accelerating agent for the thiourea crosslinking agent include guanidine accelerating agents such as 1,3-diphenylguanidine (D), 1,3-di-o-tolylguanidine (DT) and 1-o-tolylbiguanide (BG), which may be used alone or in combination. Particularly, 1,3-di-o-tolylguanidine (DT) is preferred.

The proportion of the accelerating agent to be blended is preferably not less than 0.3 parts by mass and not greater than 1 part by mass based on 100 parts by mass of the overall rubber component.

(Sulfur Crosslinking Agent and Accelerating Agent)

Examples of the sulfur crosslinking agent include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine.

Particularly, sulfur is preferred as the sulfur crosslinking agent.

The proportion of the sulfur to be blended is preferably not less than 1 part by mass and not greater than 2 parts by mass based on 100 parts by mass of the overall rubber component.

Where the oil-treated sulfur powder or the dispersive sulfur is used, for example, the proportion of the sulfur is the effective proportion of sulfur contained in the oil-treated sulfur powder or the dispersive sulfur.

Where the sulfur-containing crosslinking agent is used as the crosslinking agent, the proportion of the sulfur-containing crosslinking agent is preferably adjusted so that the proportion of sulfur contained in the molecule of the sulfur-containing crosslinking agent falls within the aforementioned range based on 100 parts by mass of the overall rubber component.

Examples of the accelerating agent for the sulfur crosslinking agent include sulfur-containing accelerating agents such as a thiazole accelerating agent, a thiuram accelerating agent, a sulfenamide accelerating agent and a dithiocarbamate accelerating agent each having sulfur in a molecule thereof. These sulfur-containing accelerating agents may be used alone or in combination.

Among these accelerating agents, the thiazole accelerating agent and the thiuram accelerating agent are preferably used in combination.

Examples of the thiazole accelerating agent include 2-mercaptobenzothiazole (M), di-2-benzothiazolyl disulfide (DM), a zinc salt of 2-mercaptobenzothiazole (MZ), a cyclohexylamine salt of 2-mercaptobenzothiazole (HM, M60-OT), 2-(N,N-diethylthiocarbamoylthio)benzothiazole (64) and 2-(4'-morpholinodithio)benzothiazole (DS, MDB), which may be used alone or in combination. Particularly, di-2-benzothiazolyl disulfide (DM) is preferred.

Examples of the thiuram accelerating agent include tetramethylthiuram monosulfide (TS), tetramethylthiuram disulfide (TT, TMT), tetraethylthiuram disulfide (TET), tetrabutylthiuram disulfide (TNT), tetrakis(2-ethylhexyl)thiuram disulfide (TOT-N) and dipentamethylenethiuram tetrasulfide (TRA), which may be used alone or in combination. Particularly, tetramethylthiuram monosulfide (TS) is preferred.

Where the two types of sulfur-containing accelerating agents are used in combination, the proportion of the thiazole accelerating agent to be blended is preferably not less than 1 part by mass and not greater than 2 parts by mass based on 100 parts by mass of the overall rubber component. Further, the proportion of the thiuram accelerating agent to be blended is preferably not less than 0.3 parts by mass and not greater than 1 part by mass based on 100 parts by mass of the overall rubber component.

<Ionic Salt>

The semiconductive rubber composition preferably further contains a salt (ionic salt) containing an anion having a fluoro group and a sulfonyl group and a cation in its molecule.

The blending of the ionic salt makes it possible to further advantageously impart the semiconductive roller with semiconductivity.

Examples of the anion having the fluoro group and the sulfonyl group in the molecule of the ionic salt include fluoroalkyl sulfonate ions, bis(fluoroalkylsulfonyl)imide ions and tris(fluoroalkylsulfonyl)methide ions, which may be used alone or in combination.

Examples of the fluoroalkyl sulfonate ions include $CF_3SO_3^-$ and $C_4F_9SO_3^-$, which may be used alone or in combination.

Examples of the bis(fluoroalkylsulfonyl)imide ions include $(CF_3SO_2)_2N^-$, $(CF_5SO_2)_2N^-$, $(C_4F_9SO_2)(CF_3SO_2)N^-$, $(FSO_2C_6F_4)(CF_3SO_2)N^-$, $(C_8F_{17}SO_2)(CF_3SO_2)N^-$, $(CF_3CH_2OSO_2)_2N^-$, $(CF_3CF_2CH_2OSO_2)_2N^-$, $(HCF_2CF_2CH_2OSO_2)_2N^-$ and $[(CF_3)_2CHOSO_2]_2N^-$, which may be used alone or in combination.

Examples of the tris(fluoroalkylsulfonyl)methide ions include $(CF_3SO_2)_3C^-$ and $(CF_3CH_2OSO_2)_3C^-$, which may be used alone or in combination.

Examples of the cation include ions of alkali metals such as sodium, lithium and potassium, ions of Group II elements such as beryllium, magnesium, calcium, strontium and barium, ions of transition elements, cations of amphoteric elements, a quaternary ammonium ion and an imidazolium cation, which may be used alone or in combination.

Particularly, lithium salts containing the lithium ion as the cation and potassium salts containing the potassium ion as the cation are preferred as the ionic salt.

Among these ionic salts, $(CF_3SO_2)_2NLi$ (lithium bis(trifluoromethanesulfonyl)imide) and/or $(CF_3SO_2)_2NK$ (potassium bis(trifluoromethanesulfonyl)imide) are preferred for improvement of the ion conductivity of the semiconductive rubber composition for reduction of the roller resistance of the semiconductive roller.

The proportion of the ionic salt to be blended is preferably not less than 0.5 parts by mass and not greater than 5 parts by mass based on 100 parts by mass of the overall rubber component.

If the proportion of the ionic salt is less than the aforementioned range, it will be impossible to sufficiently provide the effect of improving the ion conductivity of the semiconductive roller to reduce the roller resistance of the semiconductive roller.

If the proportion of the ionic salt is greater than the aforementioned range, on the other hand, the intended effect will not be further enhanced, but an excess amount of the ionic salt is liable to bloom on the outer peripheral surface of the semiconductive roller to contaminate the photoreceptor body and to hinder the formation of the oxide film by the irradiation with the ultraviolet radiation.

<Other Ingredients>

As required, the semiconductive rubber composition may further contain various additives. Examples of the additives include a crosslinking assisting agent, an acid accepting agent, a plasticizing agent, a processing aid, a degradation preventing agent, a filler, an anti-scorching agent, a lubricant, a pigment, an anti-static agent, a flame retarder, a neutralizing agent, a nucleating agent and a co-crosslinking agent.

The types and the proportions of these additives may be determined particularly in consideration of proper balance between the resistance of the semiconductive roller and the effect of suppressing the adhesion and the accumulation of the external additives on the outer peripheral surface.

Examples of the crosslinking assisting agent include metal compounds such as zinc white, fatty acids such as stearic acid, oleic acid and cotton seed fatty acids, and other conventionally known crosslinking assisting agents, which may be used alone or in combination.

The proportion of the crosslinking assisting agent to be blended is preferably not less than 3 parts by mass and not greater than 7 parts by mass based on 100 parts by mass of the overall rubber component.

In the presence of the acid accepting agent, chlorine-containing gases generated from the epichlorohydrin rubber and the CR during the crosslinking of the rubber component are prevented from remaining in the semiconductive roller. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 3 parts by mass and not greater than 7 parts by mass based on 100 parts by mass of the overall rubber component.

Examples of the plasticizing agent include plasticizers such as dibutyl phthalate (DBP), dioctyl phthalate (DOP) and tricresyl phosphate, and waxes such as polar waxes. Examples of the processing aid include metal salts of fatty acids such as zinc stearate.

The proportion of the plasticizing agent and/or the processing aid to be blended is preferably not greater than 3 parts by mass based on 100 parts by mass of the overall rubber component.

Examples of the degradation preventing agent include various anti-aging agents and anti-oxidants.

The anti-aging agents serve to reduce the environmental dependence of the roller resistance of the semiconductive roller and to suppress the increase in roller resistance during continuous energization of the semiconductive roller. Examples of the anti-aging agents include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

The proportion of the anti-aging agent to be blended is preferably not less than 0.3 parts by mass and not greater than 1 part by mass based on 100 parts by mass of the overall rubber component.

Examples of the filler include zinc oxide, silica, carbon, carbon black, clay, talc, calcium carbonate, magnesium carbonate and aluminum hydroxide, which may be used alone or in combination.

The blending of the filler improves the mechanical strength and the like of the semiconductive roller.

The proportion of the filler to be blended is preferably not less than 5 parts by mass and not greater than 20 parts by mass based on 100 parts by mass of the overall rubber component.

An electrically conductive filler such as electrically conductive carbon black may be blended as the filler to impart the semiconductive roller with electron conductivity.

An example of the electrically conductive carbon black is acetylene black.

The proportion of the electrically conductive carbon black to be blended is preferably not less than 1 part by mass and not greater than 5 parts by mass based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be blended is preferably not less than 0.1 part by mass and not greater than 1 part by mass based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;
(b) dicarboxylic acids such as maleic acid, fumaric acid and itaconic acid;
(c) esters and anhydrides of the unsaturated carboxylic acids (a) and (b);
(d) metal salts of the monomers (a) to (c);
(e) aliphatic conjugated dienes such as 1,3-butadiene, isoprene and 2-chloro-1,3-butadiene;
(f) aromatic vinyl compounds such as styrene, α-methylstyrene, vinyltoluene, ethylvinylbenzene and divinylbenzene;
(g) vinyl compounds such as triallyl isocyanurate, triallyl cyanurate and vinylpyridine each having a hetero ring; and
(h) cyanovinyl compounds such as (meth)acrylonitrile and α-chloroacrylonitrile, acrolein, formyl sterol, vinyl methyl ketone, vinyl ethyl ketone and vinyl butyl ketone.

These ethylenically unsaturated monomers may be used alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth)acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

(Preparation of Semiconductive Rubber Composition)

The semiconductive rubber composition containing the ingredients described above can be prepared in a conventional manner.

First, the rubbers for the rubber component are blended in the predetermined proportions, and the resulting rubber component is simply kneaded. After the ionic salt and additives other than the crosslinking component are added to and kneaded with the rubber component, the crosslinking component is finally added to and further kneaded with the resulting mixture. Thus, the semiconductive rubber composition is prepared.

A sealed kneading machine such as an Intermix mixer, a Banbury mixer, a kneader or an extruder, an open roll or the like, for example, is usable for the kneading.

<<Semiconductive Roller (2)>>

Figure 16A:
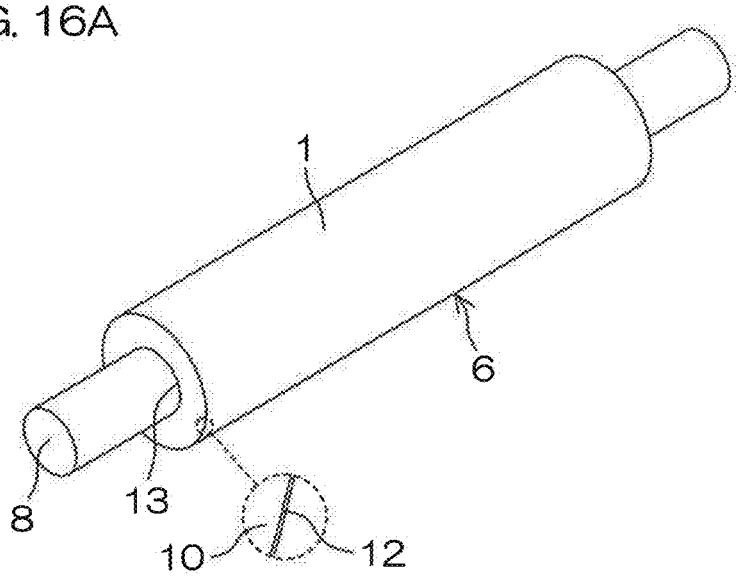
FIG. 16A is a perspective view showing the overall appearance of a semiconductive roller according to further another embodiment of the present invention.
Figure 16B:
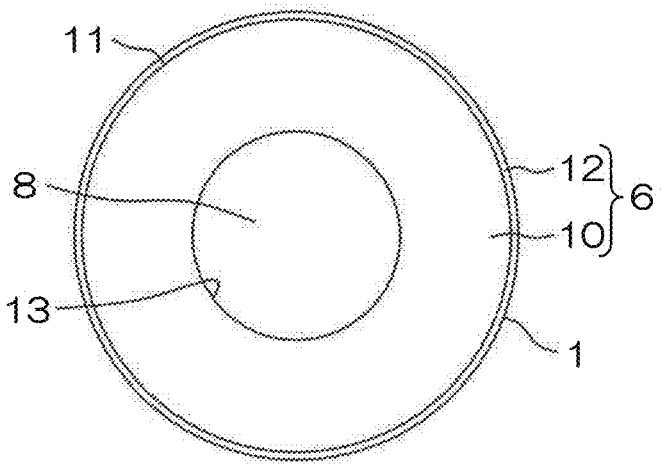
FIG. 16B is an end view of the semiconductive roller.

FIG. 16A is a perspective view showing the overall appearance of a semiconductive roller having an outer peripheral surface formed with the concavities according to further another embodiment of the present invention, and FIG. 16B is an end view of the semiconductive roller.

Figure 17A:
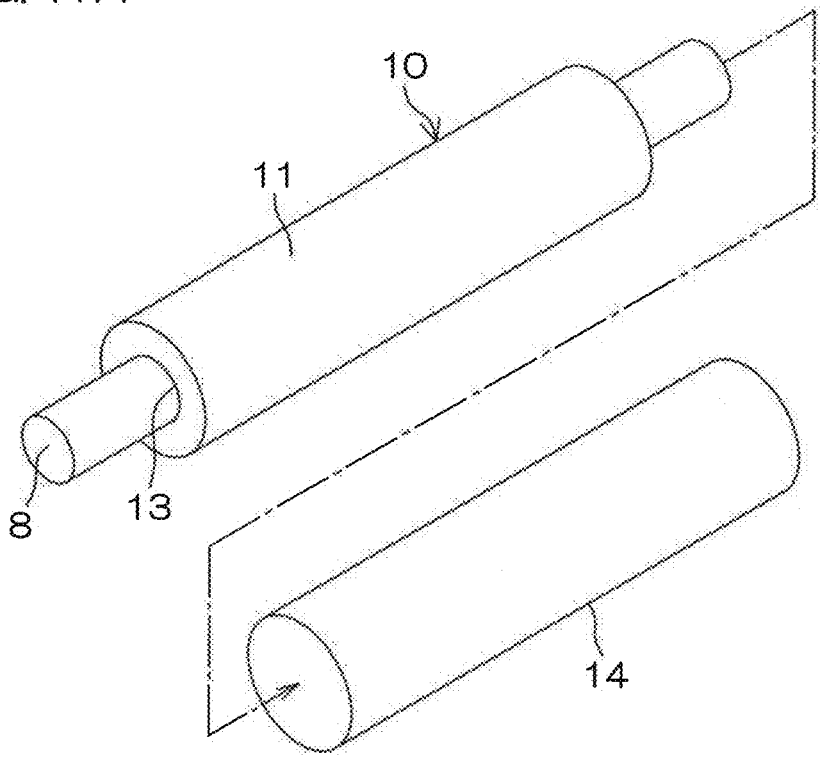
FIG. 17A is a perspective view showing an exemplary process for producing the semiconductive roller of FIGS. 16A and 16B.
Figure 17B:
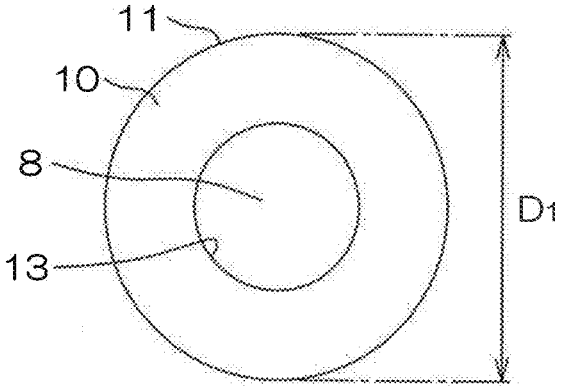
FIG. 17B is an end view of an inner layer to be used in the above process.
Figure 17C:
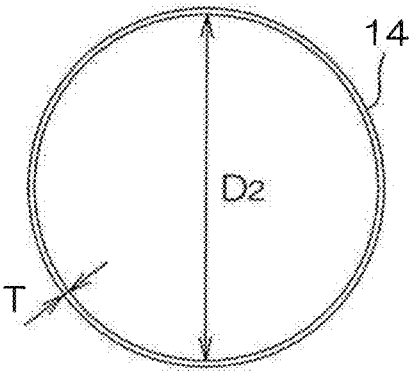
FIG. 17C is an end view of a tube which later serves as an outer layer.
Figure 18:
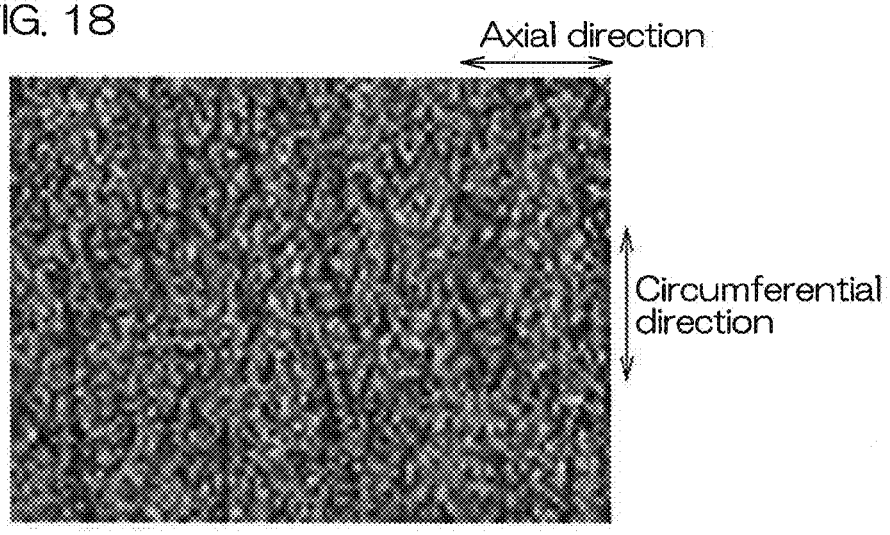
FIG. 18 is an actual microscopic photograph showing a part of an outer peripheral surface of a semiconductive roller according to a conventional art on an enlarged scale.

FIG. 17A is a perspective view showing an exemplary process for producing the semiconductive roller of FIGS. 16A and 16B. FIG. 17B is an end view of an inner layer to be used in the above process, and FIG. 17C is an end view of a tube which later serves as an outer layer.

Referring to FIGS. 16A and 16B, the semiconductive roller 6 according to this embodiment includes a tubular porous inner layer 10 of a semiconductive rubber composition, and a outer layer 12 of a seamless semiconductive thermoplastic elastomer tube provided on an outer peripheral surface 11 of the inner layer 10.

A shaft 8 is inserted through and fixed to a center through-hole 13 of the tubular inner layer 10.

As in the aforementioned embodiment, the shaft 8 is a unitary member made of a metal such as iron, aluminum, an aluminum alloy or a stainless steel. The shaft 8 is electrically connected to and mechanically fixed to the inner layer 10, for example, via an electrically conductive adhesive agent.

Alternatively, a shaft having an outer diameter that is greater than the inner diameter of the through-hole 13 is used as the shaft 8, and press-inserted into the through-hole 13 to be electrically connected to and mechanically fixed to the inner layer 10. Thus, the shaft 8 and the inner layer 10 are unitarily rotatable.

The overall Asker-C hardness of the semiconductive roller 6 is limited to not less than 30 degrees and not greater than 60 degrees.

If the overall Asker-C hardness is less than the aforementioned range, the outer layer 12 is liable to be displaced with respect to the inner layer 10, for example, during image formation, because the outer layer 12 applies an insufficient tightening force to the inner layer 10 when the semiconductive roller 6 is produced, as will be described later, by press-inserting the inner layer 10 into the tube 14 serving as the outer layer 12 (see FIGS. 17A to 17C).

If the overall Asker-C hardness is greater than the aforementioned range, on the other hand, the semiconductive roller 6 is liable to have lower flexibility. Therefore, when the semiconductive roller 6 is kept in abutment against the photoreceptor body for use as a charging roller, it will be impossible to provide a sufficient contact area with respect to the photoreceptor body. This may result in a photoreceptor charging failure and hence image density reduction.

Where the overall Asker-C hardness of the semiconductive roller 6 falls within the aforementioned range, in contrast, the semiconductive roller 6 is free from the displacement of the outer layer 12. In addition, the semiconductive roller 6 is imparted with proper flexibility, thereby advantageously suppressing the photoreceptor charging failure and the associated image density reduction.

For further improvement of this effect, the overall Asker-C hardness of the semiconductive roller 6 is preferably not less than 45 degrees and not greater than 50 degrees within the aforementioned range.

In the present invention, the overall Asker-C hardness of the semiconductive roller 6 is measured at a temperature of 23±2° C. by a measuring method specified in Society of Rubber Industry, Japan, Standard SRIS 0101 "Physical Testing Method for Expanded Rubber."

In the production method according to this embodiment, referring to FIGS. 17A to 17C, a seamless semiconductive thermoplastic elastomer tube for an outer layer 12, and a tubular inner layer 10 having an outer diameter $D_1$ greater than the inner diameter $D_2$ of the tube 14 with a shaft 8 preliminarily inserted through and fixed to a center throughhole 13 thereof are prepared, and the inner layer 10 is press-inserted into the tube 14.

In this manner, the inner layer 10 is electrically connected to and mechanically fixed to the tube 14. Thus, the outer layer 12 of the tube 14 is provided around the inner layer 10.

Thereafter, a surface (outer peripheral surface 1) of the outer layer 12 is scanned with a laser beam narrowed to a spot shape corresponding to the contour of a predetermined concavity 2 as described above for irradiation of concavity formation regions with the laser beam, whereby a multiplicity of concavities 2 are formed in the outer peripheral surface 1. Thus, the semiconductive roller 6 is produced.

The wall thickness T of the tube 14 is not less than 100 μm and not greater than 400 μm, and an interference represented by a difference $D_1$-$D_2$ between the outer diameter $D_1$ of the inner layer 10 and the inner diameter $D_2$ of the tube 14 is not less than 100 μm and not greater than 400 μm.

The wall thickness T of the tube 14 is limited to not less than 100 μm and not greater than 400 μm for the following reason.

If the wall thickness T is less than the aforementioned range, the tube 14 cannot be easily formed as having a uniform wall thickness.

If the wall thickness T of the tube 14 is greater than the aforementioned range, on the other hand, the semiconductive roller 6 is liable to have lower flexibility with an overall Asker-C hardness of greater than 60 degrees. This may result in the photoreceptor charging failure and hence the image density reduction as described above.

Where the wall thickness T of the tube 14 falls within the aforementioned range, in contrast, it is possible to impart the outer layer 12 of the tube 14 with a uniform thickness and a flexibility satisfying the requirement for an overall Asker-C hardness of not greater than 60 degrees. The semiconductive roller 6 thus produced is capable of advantageously suppressing the photoreceptor charging failure and the associated image density reduction.

The interference ($D_1$-$D_2$) of the outer layer 12 with respect to the inner layer 10 is limited to not less than 100 μm and not greater than 400 μm for the following reason.

If the interference is less than the aforementioned range, the tightening force to be applied to the inner layer 10 by the outer layer 12 will be insufficient, so that the outer layer 12 is liable to be displaced with respect to the inner layer 10.

If the interference is greater than the aforementioned range, on the other hand, the tightening force to be applied to the inner layer 10 by the outer layer 12 will be too strong, so that the semiconductive roller 6 is liable to have lower flexibility with an overall Asker-C hardness of greater than 60 degrees. This may result in the photoreceptor charging failure and hence the image density reduction. Where the outer layer 12 has a smaller thickness, for example, the outer layer 12 is liable to be broken during the image formation.

Where the interference falls within the aforementioned range, in contrast, the semiconductive roller 6 thus produced is substantially free from the displacement and the breakage of the outer layer 12 during the image formation, and has a flexibility satisfying the requirement for an overall Asker-C hardness of not greater than 60 degrees, and is capable of advantageously suppressing the photoreceptor charging failure and the associated image density reduction.

Various materials may be employed for the formation of the inner layer 10 and the outer layer 12 of the semiconductive roller 6 shown in FIGS. 16A and 16B.

The inner layer 10 is preferably a porous layer formed from a semiconductive rubber composition containing an ethylene propylene rubber and a paraffin oil. The outer layer 12 is preferably formed of a seamless semiconductive tube 14 of a thermoplastic polyamide elastomer.

At least the ethylene propylene rubber, which is highly affinitive and highly compatible with the paraffin oil, is selected as the rubber component of the semiconductive rubber composition for the inner layer 10. Further, the blending of the paraffin oil reduces the melt viscosity of the semiconductive rubber composition, and improves the foamability. In this state, the semiconductive rubber composition is foamed and crosslinked. Therefore, the expansion ratio of a foam of the semiconductive rubber composition is increased to improve the flexibility of the inner layer 10 of the foam.

The outer layer 12 is formed of the tube of the thermoplastic polyamide elastomer, which is less affinitive and less compatible with the ethylene propylene rubber and the paraffin oil, and therefore functions as a barrier layer against the paraffin oil. Thus, the paraffin oil contained in the inner layer 10 is substantially prevented from bleeding on the outer peripheral surface 1 of the semiconductive roller 6 to contaminate the photoreceptor body.

According to this embodiment, the combination of the inner layer 10 and the outer layer 12 prevents the semiconductive roller 6 from contaminating the photoreceptor body, and imparts the semiconductive roller 6 with a flexibility satisfying the requirement for an overall Asker-C hardness of not greater than 60 degrees.

<Inner Layer 10>

(Ethylene Propylene Rubber)

Examples of the ethylene propylene rubber usable as a material for the inner layer 10 include ethylene propylene rubbers (EPM) as copolymers of ethylene and propylene, and ethylene propylene diene rubbers (EPDM) as copolymers of ethylene, propylene and a diene. Particularly, the EPDM is preferred.

Various copolymers prepared by copolymerizing ethylene, propylene and a diene are usable as the EPDM. Examples of the diene include ethylidene norbornene (ENE) and dicyclopentadiene (DCPD).

Examples of the EPDM in which the diene is ENB include ESPRENE (registered trade name) EPDM 501A (having a Mooney viscosity $ML_{1+4}$ (100° C.) of 44, an ethylene content of 52% and a diene content of 4.0%) and 505A (having a Mooney viscosity $ML_{1+4}$ (100° C.) of 47, an ethylene content of 50% and a diene content of 9.5%) available from Sumitomo Chemical Co., Ltd.

Examples of the EPDM in which the diene is DCPD include ESPRENE EPDM 301A (having a Mooney viscosity $ML_{1+4}$ (100° C.) of 44, an ethylene content of 50% and a diene content of 5.0%), 301 (having a Mooney viscosity $ML_{1+4}$ (100° C.) of 55, an ethylene content of 62% and a diene content of 3.0%) and 305 (having a Mooney viscosity $ML_{1+4}$ (100° C.) of 60, an ethylene content of 60% and a diene content of 7.5%) available from Sumitomo Chemical Co., Ltd., which may be used alone or in combination.

The aforementioned EPDMs are non-oil-extension type EPDMs. In addition, oil-extension type EPDMs extended with an extension oil are also known. Of these oil-extension type EPDMs, an EPDM extended with a paraffin oil may be used as the EPDM plus the paraffin oil in the present invention.

The aforementioned EPDMs may be used alone or in combination.

(Other Rubber for Rubber Component)

For further improvement of the aforementioned effects of the combinational use of the ethylene propylene rubber, the paraffin oil and the thermoplastic polyamide elastomer, the ethylene propylene rubber (which may include two or more types of ethylene propylene rubbers) is preferably used alone as the rubber component for the inner layer 10.

However, other rubber may be used in combination with the ethylene propylene rubber, as long as the aforementioned effects are not impaired.

Examples of the other rubber include a natural rubber, an isoprene rubber, a butadiene rubber, a styrene butadiene rubber, an acrylonitrile butadiene rubber and a chloroprene rubber, which may be used alone or in combination.

The proportion of the other rubber is preferably not greater than 20 parts by mass, particularly preferably not greater than 10 parts by mass, based on 100 parts by mass of the overall rubber component.

(Paraffin Oil)

Various paraffin oils highly compatible with the ethylene propylene rubber are usable as the paraffin oil.

Examples of the paraffin oil include DIANA (registered trade name) PROCESS OIL PW series available from Idemitsu kosan Co., Ltd., which may be used alone or in combination.

The proportion of the paraffin oil is preferably not less than 20 parts by mass and not greater than 100 parts by mass based on 100 parts by mass of the overall rubber component containing at least the ethylene propylene rubber.

If the proportion of the paraffin oil is less than the aforementioned range, it will be impossible to sufficiently provide the effects of the blending of the paraffin oil for reducing the melt viscosity of the semiconductive rubber composition to improve the foamability and for increasing the expansion ratio of the foam to improve the flexibility of the inner layer 10 and the semiconductive roller 6. That is, it will be impossible to impart the semiconductive roller 6 with a flexibility satisfying the requirement for an overall Asker-C hardness of not greater than 60 degrees.

If the proportion of the paraffin oil is greater than the aforementioned range, on the other hand, an excess amount of the paraffin oil will bleed in an interface between the outer layer 12 and the inner layer 10 to inhibit the electrical conduction between the outer layer 12 and the inner layer 10, thereby reducing the semiconductivity of the semiconductive roller 6. Further, the outer layer 12 is liable to be displaced with respect to the inner layer 10.

Where the proportion of the paraffin oil falls within the aforementioned range, in contrast, it is possible to impart the semiconductive roller 6 with a higher flexibility satisfying the requirement for an overall Asker-C hardness of not greater than 60 degrees by improving the foamability of the semiconductive rubber composition and increasing the expansion ratio to improve the flexibility of the inner layer 10, while suppressing the reduction in the semiconductivity of the semiconductive roller 6 and the displacement of the outer layer 12.

For further improvement of these effects, the proportion of the paraffin oil is preferably not less than 40 parts by mass and not greater than 60 parts by mass based on 100 parts by mass of the overall rubber component within the aforementioned range.

Where the oil-extension type EPDM containing the paraffin oil as the extension oil is used, as described above, the oil-extension type EPDM to be used may contain the extension oil in a proportion falling within the aforementioned range based on 100 parts by mass of the EPDM.

If the amount of the extension oil is insufficient, the paraffin oil may be added to the semiconductive rubber composition. If the amount of the extension oil is excessive, the non-oil-extension type EPDM or the like may be added to the semiconductive rubber composition.

The semiconductive rubber composition for the inner layer 10 is prepared by blending predetermined proportions of the rubber component containing at least the ethylene propylene rubber, the paraffin oil, a crosslinking component for crosslinking the rubber component, a foaming component for foaming the rubber composition to impart the inner layer 10 with a porous structure, and an electrically conductive agent for imparting the inner layer 10 with semiconductivity.

<Crosslinking Component>

The crosslinking component for crosslinking the ethylene propylene rubber includes a crosslinking agent and an accelerating agent.

Examples of the crosslinking agent include a sulfur crosslinking agent, a thiourea crosslinking agent, a triazine derivative crosslinking agent, a peroxide crosslinking agent and monomers, which may be used alone or in combination Examples of the sulfur crosslinking agent include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine.

Examples of the thiourea crosslinking agent include tetramethylthiourea, trimethylthiourea, ethylene thiourea and thioureas represented by $(C_nH_{2n+1}NH)_2C{=}S$ (wherein n is a number of 1 to 10). These thiourea crosslinking agents may be used alone or in combination.

Examples of the peroxide crosslinking agent include benzoyl peroxide and the like.

Where the ethylene propylene rubber is the EPDM, the sulfur is preferred as the crosslinking agent.

The proportion of the sulfur to be blended is preferably not less than 0.5 parts by mass and not greater than 3 parts by mass based on 100 parts by mass of the overall rubber component containing at least the ethylene propylene rubber.

Where the oil-treated sulfur powder or the dispersive sulfur is used, for example, the proportion of the sulfur is the effective proportion of sulfur contained in the oil-treated sulfur powder or the dispersive sulfur.

Where the sulfur-containing crosslinking agent is used as the crosslinking agent, the proportion of the sulfur-containing crosslinking agent is preferably adjusted so that the proportion of sulfur contained in the molecule of the sulfur-containing crosslinking agent falls within the aforementioned range based on 100 parts by mass of the overall rubber component.

Examples of the accelerating agent include inorganic accelerating agents such as lime, magnesia (MgO) and litharge (PbO), and organic accelerating agents, which may be used alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used alone or in combination.

Different types of accelerating agents have different functions and, therefore, are preferably used in combination.

The proportion of each of the accelerating agents to be blended may be properly determined depending on the type of the accelerating agent, but is preferably not less than 0.5 parts by mass and not greater than 3 parts by mass based on 100 parts by mass of the overall rubber component.

(Foaming Component)

Various foaming agents which are thermally decomposed to generate gas are usable as the foaming component.

Examples of the foaming agents include azodicarbonamide (ADCA), 4,4'-oxybis(benzenesulfonylhydrazide) (OBSH) and N,N-dinitrosopentamethylene tetramine (DPT), which may be used alone or in combination.

The proportion of the foaming agent is preferably not less than 3 parts by mass and not greater than 8 parts by mass based on 100 parts by mass of the overall rubber component.

If the proportion of the foaming agent is less than the aforementioned range, the expansion ratio of the inner layer 10 will be insufficient. Therefore, the semiconductive roller 6 is liable to have lower flexibility with an overall Asker-C hardness of greater than 60 degrees. This may result in the photoreceptor charging failure and hence the image density reduction.

If the proportion of the foaming agent is greater than the aforementioned range, on the other hand, the expansion ratio of the inner layer 10 will be excessively high. Therefore, the semiconductive roller 6 is liable to have an overall Asker-C hardness of less than 30 degrees. This may result in the displacement of the outer layer with respect to the inner layer, for example, during the image formation.

Where the foaming agent is the ADCA, a foaming assisting agent such as urea which reduces the decomposition temperature of the ADCA to promote the decomposition of the ADCA may be used in combination with the ADCA.

The proportion of the foaming assisting agent to be blended is properly determined depending on the type of the foaming agent to be used in combination with the foaming assisting agent, but preferably not less than 1 part by mass and not greater than 3 parts by mass based on 100 parts by mass of the overall rubber component.

(Electrically Conductive Agent)

An electron conductive agent and/or an ion conductive agent may be used as the electrically conductive agent. Particularly, the electron conductive agent is preferred.

Examples of the electron conductive agent include various electron conductive carbon blacks and graphites, which may be used alone or in combination.

The proportion of the electron conductive agent to be blended is preferably not less than 30 parts by mass and not greater than 60 parts by mass based on 100 parts by mass of the overall rubber component.

If the proportion of the electron conductive agent is less than the aforementioned range, the inner layer 10 is liable to have an excessively high resistance, making it impossible to impart the entire semiconductive roller 6 with satisfactory semiconductivity. This may result in reduction in solid black image density, for example.

If the proportion of the electron conductive agent is greater than the aforementioned range, on the other hand, even the paraffin-containing inner layer 10 is liable to have a higher hardness. Hence, the semiconductive roller 6 is liable to have a higher hardness, i.e., an overall Asker-C hardness of greater than 60 degrees, and lower flexibility. This may result in the photoreceptor charging failure and hence the image density reduction.

(Other Additives)

As required, the semiconductive rubber composition may further contain various additives. Examples of the additives include a crosslinking assisting agent, a degradation preventing agent, a filler, an anti-scorching agent, a lubricant, a pigment, an anti-static agent, a flame retarder, a neutralizing agent, a nucleating agent and a co-crosslinking agent.

Usable examples of the additives include those previously described.

(Preparation of Semiconductive Rubber Composition)

The semiconductive rubber composition containing the ingredients described above can be prepared in a conventional manner.

First the rubber component is simply kneaded. After the paraffin oil, the electrically conductive agent and the additives other than the crosslinking component and the foaming component are added to and kneaded with the rubber component, the crosslinking component and the foaming component are finally added to and kneaded with the resulting mixture. Thus, the semiconductive rubber composition is prepared.

A sealed kneading machine such as an Intermix mixer, a Banbury mixer, a kneader or an extruder, an open roll or the like, for example, is usable for the kneading.

(Formation of Inner Layer 10)

For the formation of the inner layer 10, the semiconductive rubber composition described above is extruded into a tubular body by means of an extruder, and the tubular body is cut to a predetermined length. Then, the resulting tubular body is foamed and crosslinked by pressure and heat.

In turn, the foamed and crosslinked tubular body is heated in an oven to be thereby secondarily crosslinked, then cooled, and polished to a predetermined outer diameter $D_1$.

<Shaft 8>

The shaft 8 may be inserted through and fixed to a through-hole 13 of the tubular body at any time between the end of the cutting of the tubular body and the end of the press-insertion of the inner layer 10 in the tube 14.

However, it is preferred that, with the shaft 8 inserted through and fixed to the through-hole 13 after the cutting, the tubular body is secondarily crosslinked and polished and the resulting inner layer 10 is press-inserted into the tube 14 as shown in FIG. 17A.

Thus, the warpage and the deformation of the inner layer 10 can be prevented which may otherwise occur due to the expansion and the contraction of the tubular body during the secondary crosslinking. The tubular body may be polished while being rotated about the shaft 8. This improves the working efficiency in the polishing, and suppresses the deflection of the outer peripheral surface 11. Further, the inner tube 10 can be press-inserted into the tube 14 with an improved working efficiency.

As previously described, the shaft 8 is electrically connected to and mechanically fixed to the inner layer 10 via an electrically conductive thermosetting adhesive agent. Alternatively, a shaft having an outer diameter that is greater than the inner diameter of the through-hole 13 is used as the shaft 8, and press-inserted into the through-hole 13 to be electrically connected to and mechanically fixed to the inner layer 10. Thus, the shaft 8 and the inner layer 10 are unitarily rotatable.

In the former case, the thermosetting adhesive agent is cured when the tubular body is secondarily crosslinked by the heating in the oven. Thus, the shaft 8 is electrically connected to and mechanically fixed to the inner layer 10.

In the latter case, the electrical connection and the mechanical fixing are achieved simultaneously with the press insertion.

<Outer Layer 12>

The outer layer 12 is formed of a seamless semiconductive thermoplastic elastomer tube 14 as described above.

The tube 14 is formed by extruding an elastomer composition containing a thermoplastic elastomer into a tubular body having a predetermined wall thickness T and a predetermined inner diameter $D_2$.

Where the inner layer 10 is formed of the ethylene propylene rubber containing the paraffin oil, the thermoplastic elastomer for the tube 14 is preferably the thermoplastic polyamide elastomer as described above.

Examples of the thermoplastic polyamide elastomer include block copolymers containing a hard segment of a polyamide, and a soft segment of at least one of polyethers, polyesters, polypropylene glycols and polytetramethylene ether glycols. These block copolymers may be used alone or in combination.

In order to impart the tube 14 with semiconductivity, an electron conductive agent and/or an ion conductive agent may be blended in the elastomer composition for the tube 14. Particularly, the electron conductive agent is preferred for prevention of the contamination of the photoreceptor drum, the toner and peripheral components which may otherwise occur due to bleeding.

Examples of the electron conductive agent include the electron conductive carbon blacks and graphites described above, and carbon fibrils such as carbon nanotubes, which may be used alone or in combination.

In consideration of the costs and the characteristic properties of the semiconductive roller, a carbon black having a greater DBP oil absorption amount is preferred because even addition of a small amount of the carbon black makes it possible to form an electrically conductive circuit and to control the resistance.

The proportion of the carbon black to be blended is preferably not greater than 30 parts by mass, particularly preferably not greater than 15 parts by mass, based on 100 parts by mass of the thermoplastic polyamide elastomer.

If the proportion of the carbon black is greater than the aforementioned range, the outer layer 12 is liable to have a higher hardness to degrade the toner, and the costs will be increased.

The proportion of the carbon black does not have a particular lower limit, but is preferably not less than 0.5 parts by mass, particularly preferably not less than 1 part by mass, based on 100 parts by mass of the thermoplastic polyamide elastomer in order to impart the tube 14 with proper semiconductivity.

The construction of the inventive semiconductive roller is not limited to those of the embodiments described with reference to FIGS. 1 to 17C.

For example, the semiconductive roller 6 shown in FIG. 15 has a single layer structure (with the oxide film 9 excluded) not by way of limitation, but may have a multilayer structure including two rubber layers, i.e., an outer rubber layer adjacent to the outer peripheral surface 1 and an inner rubber layer adjacent to the shaft 8.

The inventive semiconductive roller can be advantageously used not only as the charging roller but also as a developing roller, a transfer roller, a cleaning roller or the like in an electrophotographic image forming apparatus such as a laser printer, an electrostatic copying machine, a plain paper facsimile machine or a printer-copier-facsimile multifunction machine.

EXAMPLES

Example 1-1

(Preparation of Semiconductive Rubber Composition)

The following rubbers were blended for a rubber component.

(A) 15 parts by mass of an ECO (EPICHLOMER (registered trade name) D available from Osaka Soda Co., Ltd. and having an ethylene oxide content of 61 mol %)

(B) 45 parts by mass of a GECO (EPION (registered trade name) 301L available from Osaka Soda Co., Ltd. and having a molar ratio of EO/EP/AGE=73/23/4)

(C) 10 parts by mass of a CR (SHOPRENE (registered trade name) WRT available from Showa Denko K.K.)

(D) 30 parts by mass of an NBR flower acrylonitrile content NBR JSR N250 SL available from JSR Co., Ltd. and having an acrylonitrile content of 20%)

While the rubbers (A) to (D) for 100 parts by mass of the rubber component were simply kneaded by means of a Banbury mixer, ingredients other than a crosslinking component shown below in Table 1 were added to and kneaded with the rubber component, and the crosslinking component was finally added to and further kneaded with the resulting mixture. Thus, semiconductive rubber composition was prepared.

TABLE 1

| Ingredients | Parts by mass |
|---|---|
| Ionic salt | 3.40 |
| Acid accepting agent | 5.00 |
| Crosslinking assisting agent | 5.00 |
| Filler | 2.00 |
| Processing aid | 1.00 |

TABLE 1-continued

| Ingredients | Parts by mass |
|---|---|
| Anti-aging agent | 0.50 |
| Thiourea crosslinking agent | 0.60 |
| Accelerating agent DT | 0.54 |
| Dispersive sulfur | 1.50 |
| Accelerating agent DM | 1.50 |
| Accelerating agent TS | 0.50 |

The ingredients shown in Table 1 are as follows. The amounts (parts by mass) shown in Table 1 are based on 100 parts by mass of the overall rubber component.

Ionic salt: Potassium bis(trifluoromethanesulfonyl)imide (EF-N112 available from Mitsubishi Materials Electronic Chemicals Co., Ltd.)

Acid accepting agent: Hydrotalcites (DHT-4A (registered trade name) 2 available from Kyowa Chemical Industry Co., Ltd.)

Crosslinking assisting agent: Zinc oxide type-2 (available from Mitsui Mining & Smelting Co., Ltd.)

Filler: Electrically conductive carbon black (particulate acetylene black DENKA BLACK (registered trade name) available from Denki Kagaku Kogyo K.K.)

Processing aid: Zinc stearate (SZ-2000 available from Sakai Chemical Industry Co., Ltd.)

Anti-aging agent: Nickel dibutyldithiocarbamate (NOCRAC (registered trade name) NBC available from Ouchi Shinko Chemical Industrial Co., Ltd.)

Thiourea crosslinking agent: Ethylene thiourea (2-mercaptoimidazoline ACCEL (registered trade name) 22-S available from Kawaguchi Chemical Industry Co., Ltd.)

Accelerating agent DT: 1,3-di-o-tolylguanidine (guanidine accelerating agent SANCELER (registered trade name) DT available from Sanshin Chemical Industry Co., Ltd.)

Dispersive sulfur: Crosslinking agent (SULFAX PS (trade name) available from Tsurumi Chemical Industry Co., Ltd. and having a sulfur content of 99.5%)

Accelerating agent DM: Di-2-benzothiazolyl disulfide (thiazole accelerating agent NOCCELER (registered trade name) DM available from Ouchi Shinko Chemical Industrial Co., Ltd.)

Accelerating agent TS: Tetramethylthiuram monosulfide (thiuram accelerating agent SANCELER TS available from Sanshin Chemical Industry Co., Ltd.)

(Production of Semiconductive Roller)

The semiconductive rubber composition was fed into a φ60 extruder, and extruded into a tubular body having an outer diameter of 11.0 mm and an inner diameter of 5.0 mm. Then, the tubular body was fitted around a temporary crosslinking shaft, and crosslinked in a vulcanization can at 160° C. for 30 minutes.

Then, the crosslinked tubular body was removed from the temporary shaft, then fitted around a metal shaft having an outer diameter of 6 mm and an outer peripheral surface to which an electrically conductive thermosetting adhesive agent (polyamide adhesive agent) was applied, and heated in an oven at 150° C. for 60 minutes. In turn, opposite end portions of the tubular body fitted around the metal shaft were cut, and the outer peripheral surface of the resulting tubular body was dry-polished to an outer diameter of 9.5 mm by means of a wide polishing machine.

The polished outer peripheral surface 1 was wiped with alcohol, and then processed with a laser beam. Thus, a multiplicity of concavities 2 were formed in the outer peripheral surface 1 to be circumferentially and axially arranged in a matrix array in circumferentially and axially overlapping relation as shown in FIGS. 1 and 2A.

The concavities 2 had the same size, and the circumferential pitch and the axial pitch of the concavities 2 were each 50 to 80 μm The spot shape of the laser beam was controlled so that the circumferentially adjacent concavities 2 overlapped to a smaller extent and the axially adjacent concavities 2 overlapped to a greater extent.

As shown in FIG. 1, the laser-processed outer peripheral surface 1 had a three-dimensional surface geometry such that the adjacent concavities 2 were connected to each other with a continuous curved surface.

After the laser-processed outer peripheral surface 1 was wiped with alcohol again, the tubular body was set in a UV treatment apparatus with the outer peripheral surface thereof spaced 50 mm from a UV light source. Then, the outer peripheral surface 1 was irradiated with ultraviolet radiation for 15 minutes while the tubular body was rotated at 300 rpm, whereby an oxide film 9 was formed in the outer peripheral surface 1. Thus, a semiconductive roller 6 was produced.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 22 μm, and a developed interfacial area ratio Sdr was 0.6 with respect to a definition area of 50000 $\mu m^2$.

Example 1-2

A semiconductive roller 6 was produced in substantially the same manner as in Example 1-1, except that the axially adjacent concavities 2 were arranged in overlapping relation and the circumferentially adjacent concavities were arranged in non-overlapping spaced relation as shown in FIGS. 7 and 8 by controlling the spot shape of the laser beam.

The concavities 2 had the same size, and the circumferential pitch and the axial pitch of the concavities 2 were each 50 to 80 μm.

Regions defined between rows of axially aligning concavities 2 axially extended parallel to each other and each had a width of about 20 μm. These regions were left unprocessed with polishing marks remaining therein. Sharp edges were present along boundaries between the rows of concavities 2 and the unprocessed regions.

The surface texture of the outer peripheral surface 1 of the semiconductive roller 6 thus produced was analyzed in the same manner as in Example 1-1. As a result, the maximum height Sz of the outer peripheral surface 1 was 30 μm, and a developed interfacial area ratio Sdr was 1.3 with respect to a definition area of 50000 $\mu m^2$.

Comparative Example 1-1

A semiconductive roller 6 was produced in substantially the same manner as in Example 1-1, except that the polished outer peripheral surface 1 was not formed with the concavities by the laser processing, but wet-polished with #400 paper by means of a wet paper polishing machine, then wiped with alcohol, and formed with an oxide film 9 by irradiation with ultraviolet radiation.

The surface texture of the outer peripheral surface 1 of the semiconductive roller 6 thus produced was analyzed in the same manner as in Example 1-1. As a result, the maximum height Sz of the outer peripheral surface 1 was 25 μm, and a developed interfacial area ratio Sdr was 5.6 with respect to a definition area of 50000 $\mu m^2$.

Comparative Example 1-2

A semiconductive roller 6 was produced in substantially the same manner as in Example 1-1, except that the axially adjacent concavities 2 and the circumferentially adjacent concavities 2 were independently formed in completely non-overlapping relation by controlling the spot shape of the laser beam.

The concavities 2 had the same size, and the circumferential pitch and the axial pitch of the concavities 2 were each 50 to 80 μm.

A region defined between the independent concavities 2 was left unprocessed with polishing marks remaining therein. Sharp edges were present along boundaries between the peripheries of the concavities 2 and the unprocessed region.

The surface texture of the outer peripheral surface 1 of the semiconductive roller 6 thus produced was analyzed in the same manner as in Example 1-1. As a result, the maximum height Sz of the outer peripheral surface 1 was 46.2 μm, and a developed interfacial area ratio Sdr was 8.2 with respect to a definition area of 50000 $\mu m^2$.

<Actual Machine Test>

A photoconductor unit (available from Lexmark International, Inc.) including a photoreceptor body and a charging roller constantly kept in contact with the surface of the photoreceptor body and attachable to a laser printer main body was prepared, and the semiconductive rollers produced in Examples and Comparative Examples were each incorporated as a charging roller instead of the original charging roller of the photoconductor unit.

After the photoconductor unit thus assembled was mounted in a color laser printer (CS510 available from Lexmark International, Inc.) and paper sheets were passed through the color laser printer at a rate of 2000 sheets per day for 5 days, the semiconductive roller was taken out, and evaluated against the adhesion and the accumulation of the external additives on the outer peripheral surface.

That is, the outer peripheral surface of the semiconductive roller was visually observed. As a result, a semiconductive roller having an outer peripheral surface entirely whitened due to the adhesion of the external additives was rated as unacceptable (×), and a semiconductive roller having an outer peripheral surface partly whitened was rated as practically acceptable (Δ). A semiconductive roller having an outer peripheral surface free from the whitening was rated as acceptable (○).

The color of the outer peripheral surface of the semiconductive roller was measured by means of a spectrophotometer before and after the sheet passage test. Based on the following criteria, the semiconductive roller was evaluated against the adhesion and the accumulation of the external additives on the outer peripheral surface.

Acceptable (○): A difference ΔE*a*b* between the colors observed before and after the sheet passage test was not greater than 3.

Practically acceptable (Δ): A difference ΔE*a*b* between the colors observed before and after the sheet passage test was greater than 3 and not greater than 7.

Unacceptable (×): A difference ΔE*a*b* between the colors observed before and after the sheet passage test was greater than 7.

The results are shown in Table 2.

TABLE 2

| | Example 1-1 | Example 1-2 | Comparative Example 1-1 | Comparative Example 1-2 |
|---|---|---|---|---|
| Whitening | | | | |
| Visual observation | ○ | Δ | x | x |
| Color difference ΔE*a*b* | | | | |
| Value | 0.7 | 3.6 | 11.2 | 10.8 |
| Evaluation | ○ | Δ | x | x |

The results shown in Table 2 indicate that the semiconductive rollers of Examples 1-1 and 1-2 each having a multiplicity of concavities formed in circumferentially and/or axially overlapping relation in the outer peripheral surface can advantageously suppress the whitening attributable to the adhesion and the accumulation of the external additives on the outer peripheral surface as compared with the semiconductive roller of Comparative Example 1-1 having no concavities in the outer peripheral surface and the semiconductive roller of Comparative Example 1-2 having a multiplicity of independent concavities formed in the outer peripheral surface.

The results also indicate that the semiconductive rollers of Examples 1-1 and 1-2 each having a multiplicity of concavities connected together to be continuously curved in the outer peripheral surface can further advantageously suppress the whitening attributable to the adhesion and the accumulation of the external additives on the outer peripheral surface.

Examples 2-1

Of ethylene propylene rubbers, an EPDM (ESPRENE EPDM 505A available from Sumitomo Chemical Co., Ltd. and having a Mooney viscosity $ML_{1+4}$ (100° C.) of 47, an ethylene content of 50% and a diene content of 9.5%) was used as a rubber component.

DIANA PROCESS OIL PW-380 available from Idemitsu kosan Co., Ltd. was used as a paraffin oil.

While 100 parts by mass of the EPDM was simply kneaded by means of a Banbury mixer, 60 parts by mass of the paraffin oil and ingredients other than a crosslinking component and a foaming component shown below in Table 3 were added to and kneaded with the EPDM, and then the crosslinking component and the foaming component were added to and further kneaded with the resulting mixture. Thus, a semiconductive rubber composition for an inner layer was prepared.

TABLE 3

| Ingredients | Parts by mass |
|---|---|
| Filler | 30 |
| Crosslinking assisting agent (I) | 5 |
| Crosslinking assisting agent (II) | 1 |
| Electron conductive agent | 50 |
| Foaming agent | 6 |
| Foaming assisting agent | 2 |
| Crosslinking agent | 1.6 |
| Accelerating agent TS | 1 |
| Accelerating agent MBTS | 2 |

The ingredients shown in Table 3 areas follows. The amounts (parts by mass) shown in Table 3 are based on 100 parts by mass of the EPDM as the rubber component.

Filler: Heavy calcium carbonate BF-300 available from Shiraishi Calcium Kaisha, Ltd.

Crosslinking agent (I): Zinc oxide type-2 available from Mitsui Mining & Smelting Co., Ltd.

Crosslinking agent (II): Stearic acid TSUBAKI (trade name) available from NOF Corporation Electron conductive agent: Carbon black ISAF SEAST 6 available from Tokai Carbon Co., Ltd.

Foaming agent: ADCA VINYFOR AC#3 available from Eiwa Chemical Industry Co., Ltd.

Foaming assisting agent: Urea foaming assisting agent CELLPASTE 101 available from Eiwa Chemical Industry Co., Ltd.

Crosslinking agent: 5% oil-containing sulfur available from Tsurumi Chemical Industry Co., Ltd.

Accelerating agent TS: Tetramethylthiuram monosulfide, thiuram accelerating agent SANCELER (registered trade name) TS available from Sanshin Chemical Industry Co., Ltd.

Accelerating agent MBTS: Di-2-benzothiazolyl disulfide, thiazole accelerating agent SANCELER DM available from Sanshin Chemical Industry Co., Ltd.

The semiconductive rubber composition was fed into an extruder, and extruded into a tubular body having an outer diameter of 11 mm and an inner diameter of 5 mm. Then, the tubular body was fitted around a temporary crosslinking shaft, and crosslinked and foamed in a vulcanization can at 160° C. for 1 hour.

Then, the crosslinked tubular body was removed from the temporary shaft, then fitted around a shaft having an outer diameter of 6 mm and an outer peripheral surface to which an electrically conductive thermosetting adhesive agent was applied, and heated in an oven at 160° C. Thus, the tubular body was bonded to the shaft. Thereafter, the outer peripheral surface of the resulting tubular body was polished to an outer diameter $D_1$ of 9.5 mm by means of a cylindrical polishing machine, and washed with water. Thus, an inner layer unified with the shaft was produced.

A seamless semiconductive thermoplastic polyamide elastomer tube (electrically conductive nylon sleeve SLV available from Gunze Limited) having a wall thickness T of 100 μm and an inner diameter $D_2$ of 9.3 mm was prepared for an outer layer. An interference represented by a difference $D_1$-$D_2$ between the outer diameter $D_1$ and the inner diameter $D_2$ was 200 μm.

After the inner layer was press-inserted into the tube, opposite ends of the resulting product were cut, and the outer peripheral surface of the tube was processed with a laser beam. Thus, a multiplicity of concavities 2 were formed in the outer peripheral surface 1 to be circumferentially and axially arranged in a matrix array in circumferentially and axially overlapping relation as shown in FIGS. 1 and 2A.

The concavities 2 had the same size, and the circumferential pitch and the axial pitch of the concavities 2 were each 50 to 80 μm.

The spot shape of the laser beam was controlled so that the circumferentially adjacent concavities 2 overlapped to a smaller extent and the axially adjacent concavities 2 overlapped to a greater extent.

As shown in FIG. 1, the laser-processed outer peripheral surface 1 had a three-dimensional surface geometry such that the adjacent concavities 2 were connected to each other with a continuous curved surface.

The surface texture of the outer peripheral surface 1 of the semiconductive roller 6 thus produced was analyzed in the same manner as in Example 1-1. As a result, the maximum height Sz of the outer peripheral surface 1 was 22 μm, and a developed interfacial area ratio Sdr was 0.6 with respect to a definition area of 50000 $\mu m^2$.

The semiconductive roller 6 had an overall Asker-C hardness of 32 degrees as measured in the aforementioned manner with a load of 1 kg.

Example 2-2

A semiconductive roller 6 was produced in substantially the same manner as in Example 2-1, except that the proportion of the ADCA blended as the foaming agent in the semiconductive rubber composition was 5 parts by mass.

The tube for the outer layer had a wall thickness T of 100 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 45 degrees.

Example 2-3

A semiconductive roller 6 was produced in substantially the same manner as in Example 2-1, except that the outer diameter $D_1$ of the inner layer was 9.3 mm, and a seamless semiconductive thermoplastic polyamide elastomer tube SLV (available from Gunze Limited) having an inner diameter $D_2$ of 9.1 mm and a wall thickness T of 200 μm was used for the outer layer.

As described above, the wall thickness T of the tube for the outer layer was 200 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 47 degrees.

Example 2-4

A semiconductive roller 6 was produced in substantially the same manner as in Example 2-1, except that the outer diameter $D_1$ of the inner layer was 8.9 mm, and a seamless semiconductive thermoplastic polyamide elastomer tube SLV (available from Gunze Limited) having an inner diameter $D_2$ of 8.7 mm and a wall thickness T of 400 μm was used for the outer layer.

As described above, the wall thickness T of the tube for the outer layer was 400 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 55 degrees.

Example 2-5

A semiconductive roller 6 was produced in substantially the same manner as in Example 2-3, except that the proportion of the paraffin oil blended in the semiconductive rubber composition was 40 parts by mass and the proportion of the ADCA as the foaming agent was 4 parts by mass.

The wall thickness T of the tube for the outer layer was 200 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 58 degrees.

Example 2-6

A semiconductive roller 6 was produced in substantially the same manner as in Example 2-3, except that the proportion of the paraffin oil blended in the semiconductive rubber composition was 40 parts by mass, the proportion of the ADCA as the foaming agent was 5 parts by mass, and the outer diameter $D_1$ of the inner layer was 9.2 mm.

The wall thickness T of the tube for the outer layer was 200 μm, and an interference represented by a difference $D_1$-$D_2$ between the outer diameter $D_1$ and the inner diameter $D_2$ was 100 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 45 degrees.

Example 2-7

A semiconductive roller 6 was produced in substantially the same manner as in Example 2-3, except that the proportion of the paraffin oil blended in the semiconductive rubber composition was 40 parts by mass, the proportion of the ADCA as the foaming agent was 5 parts by mass, and the outer diameter $D_1$ of the inner layer was 9.5 mm.

The wall thickness T of the tube for the outer layer was 200 μm, and an interference represented by a difference $D_1$-$D_2$ between the outer diameter $D_1$ and the inner diameter $D_2$ was 400 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 48 degrees.

Example 2-8

A semiconductive roller 6 was produced in substantially the same manner as in Example 2-3, except that the proportion of the paraffin oil blended in the semiconductive rubber composition was 40 parts by mass and the proportion of the ADCA as the foaming agent was 5 parts by mass.

The wall thickness T of the tube for the outer layer was 200 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 45 degrees.

Example 2-9

A semiconductive roller 6 was produced in substantially the same manner as in Example 2-8, except that the axially adjacent concavities 2 were arranged in overlapping relation and the circumferentially adjacent concavities 2 were arranged in non-overlapping spaced relation as shown in FIGS. 7 and 8 by controlling the spot shape of the laser beam.

The concavities 2 had the same size, and the circumferential pitch and the axial pitch of the concavities 2 were each 50 to 80 μm.

Regions defined between rows of axially aligning concavities 2 axially extended parallel to each other, and each had a width of about 20 μm. These regions were left unprocessed with polishing marks remaining therein. Sharp edges were present along boundaries between the rows of concavities 2 and the unprocessed regions.

The surface texture of the outer peripheral surface 1 of the semiconductive roller 6 thus produced was analyzed in the same manner as in Example 1-1. As a result, the maximum height Sz of the outer peripheral surface 1 was 30 μm, and a developed interfacial area ratio Sdr was 1.3 with respect to a definition area of 50000 $\mu m^2$.

The semiconductive roller 6 had an overall Asker-C hardness of 45 degrees.

Comparative Example 2-1

A non-expansible semiconductive rubber composition was prepared in substantially the same manner as in Example 2-1, except that the proportion of the paraffin oil blended in the semiconductive rubber composition was 50 parts by mass, and the foaming agent and foaming assisting agent were not blended.

By using the semiconductive rubber composition thus prepared, a non-porous single-layer semiconductive roller 6 having an outer diameter $D_1$ of 9.5 mm was produced in substantially the same manner as in Example 2-1, except that the outer layer was not formed. The outer peripheral surface of the semiconductive roller was mirror-polished so as to have a profile curve arithmetic average roughness Ra of 1 μm which is specified in Japanese Industrial Standards JIS $B0601_{:2013}$ "Geometrical product specifications (GPS)—Surface texture: Profile method: Terms, definitions and surface texture parameters."

The semiconductive roller had an overall Asker-C hardness of 50 degrees.

Comparative Example 2-2

A semiconductive roller 6 was produced in substantially the same manner as in Example 2-4, except that the proportion of the paraffin oil blended in the semiconductive rubber composition was 50 parts by mass and the proportion of the ADCA as the foaming agent was 2 parts by mass.

The wall thickness T of the tube for the outer layer was 400 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 65 degrees.

Comparative Example 2-3

A semiconductive roller 6 was produced in substantially the same manner as in Example 2-1, except that the proportion of the paraffin oil blended in the semiconductive rubber composition was 50 parts by mass and the proportion of the ADCA as the foaming agent was 8 parts by mass.

The wall thickness T of the tube for the outer layer was 100 μm, and an interference represented by a difference $D_1$-$D_2$ between the outer diameter $D_1$ and the inner diameter $D_2$ was 200 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 25 degrees.

Comparative Example 2-4

A semiconductive roller 6 was produced in substantially the same manner as in Example 2-3, except that the proportion of the paraffin oil blended in the semiconductive rubber composition was 50 parts by mass, the proportion of the ADCA as the foaming agent was 6 parts by mass, and the outer diameter $D_1$ of the inner layer was 9.6 mm.

The wall thickness T of the tube for the outer layer was 200 μm, and an interference represented by a difference $D_1$-$D_2$ between the outer diameter $D_1$ and the inner diameter $D_2$ was 500 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 55 degrees.

Comparative Example 2-5

A semiconductive roller 6 was produced in substantially the same manner as in Example 2-3, except that the proportion of the paraffin oil blended in the semiconductive rubber composition was 40 parts by mass, the proportion of the ADCA as the foaming agent was 4 parts by mass, and the outer diameter $D_1$ of the inner layer was 9.16 mm.

The wall thickness T of the tube for the outer layer was 200 μm, and an interference represented by a difference $D_1$-$D_2$ between the outer diameter $D_1$ and the inner diameter $D_2$ was 60 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 58 degrees.

Comparative Example 2-6

A semiconductive roller 6 was produced in substantially the same manner as in Example 2-1, except that the proportion of the paraffin oil blended in the semiconductive rubber composition was 40 parts by mass, the proportion of the ADCA as the foaming agent was 6 parts by mass, the outer diameter $D_1$ of the inner layer was 8.6 mm, and a seamless semiconductive thermoplastic polyamide elastomer tube SLV (available from Gunze Limited) having an inner diameter $D_2$ of 8.5 mm and a wall thickness T of 500 μm was used for the outer layer.

As described above, the wall thickness T of the tube for the outer layer was 500 μm, and an interference represented by a difference $D_1$-$D_2$ between the outer diameter $D_1$ and the inner diameter $D_2$ was 100 μm.

The shape and the arrangement of the concavities 2 formed in the outer peripheral surface 1 of the semiconductive roller 6 and the surface texture of the outer peripheral surface 1 were the same as those in Example 2-1. The semiconductive roller 6 had an overall Asker-C hardness of 62 degrees.

<Actual Machine Test>

A photoconductor unit (available from Lexmark International, Inc.) including a photoreceptor body and a charging roller constantly kept in contact with the surface of the photoreceptor body and attachable to a laser printer main body was prepared, and the semiconductive rollers produced in Examples and Comparative Examples were each incorporated as a charging roller instead of the original charging roller of the photoconductor unit.

Immediately after the photoconductor unit thus assembled was mounted in a color laser printer (CS510 available from Lexmark International, Inc.), a solid image was formed. Based on the solid image thus formed, the semiconductive roller was evaluated against image density reduction.

That is, the formed solid image was visually observed. As a result, a semiconductive roller causing image density reduction was rated as unacceptable (×), and a semiconductive roller causing slight image density reduction was rated as practically acceptable (Δ). A semiconductive roller free from the image density reduction was rated as acceptable (○).

After the photoconductor unit was mounted in the color laser printer and paper sheets were passed through the color laser printer at a rate of 2000 sheets per day for 5 days, the semiconductive roller was taken out, and evaluated against the adhesion and the accumulation of external additives on the outer peripheral surface.

That is, the outer peripheral surface of the semiconductive roller was visually observed. As a result, a semiconductive roller having an outer peripheral surface entirely whitened due to the adhesion of the external additives was rated as unacceptable (×), and a semiconductive roller having an outer peripheral surface partly whitened was rated as practically acceptable (Δ). A semiconductive roller having an outer peripheral surface free from the whitening was rated as acceptable (○).

Further, the state of the outer layer was checked.

The results are shown in Tables 4 to 6.

TABLE 4

| | Example 2-1 | Example 2-2 | Example 2-3 | Example 2-4 | Example 2-5 |
|---|---|---|---|---|---|
| | Parts by mass | | | | |
| Paraffin oil | 60 | 60 | 60 | 60 | 40 |
| Foaming agent | 6 | 5 | 6 | 6 | 4 |
| Foaming assisting agent | 2 | 2 | 2 | 2 | 2 |
| Outer diameter $D_1$ (mm) of inner layer | 9.5 | 9.5 | 9.3 | 8.9 | 9.3 |
| Inner diameter $D_2$ (mm) of outer layer | 9.3 | 9.3 | 9.1 | 8.7 | 9.1 |
| Wall thickness T (μm) of tube | 100 | 100 | 200 | 400 | 200 |
| Interference $D_1 - D_2$ (μm) | 200 | 200 | 200 | 200 | 200 |
| Asker-C hardness (degrees) | 32 | 45 | 47 | 55 | 58 |
| Concavities | Present | Present | Present | Present | Present |
| Image density | ○ | ○ | ○ | Δ | Δ |
| Whitening | ○ | ○ | ○ | ○ | ○ |
| State of semiconductive roller | Normal*1 | Normal | Normal | Normal | Normal |

*1Slight displacement of outer layer not as much as that observed in Comparative Examples 2-3 and 2-5 was observed, but practically acceptable.

TABLE 5

| | Example 2-6 | Example 2-7 | Example 2-8 | Example 2-9 | Comparative Example 2-1 |
|---|---|---|---|---|---|
| | Parts by mass | | | | |
| Paraffin oil | 40 | 40 | 40 | 40 | 50 |
| Foaming agent | 5 | 5 | 5 | 5 | — |
| Foaming assisting agent | 2 | 2 | 2 | 2 | — |
| Outer diameter $D_1$ (mm) of inner layer | 9.2 | 9.5 | 9.3 | 9.3 | 9.5 |
| Inner diameter $D_2$ (mm) of outer layer | 9.1 | 9.1 | 9.1 | 9.1 | — |
| Wall thickness T (μm) of tube | 200 | 200 | 200 | 200 | — |
| Interference $D_1 - D_2$ (μm) | 100 | 400 | 200 | 200 | — |
| Asker-C hardness (degrees) | 45 | 48 | 45 | 45 | 50 |
| Concavities | Present | Present | Present | Present | Absent |
| Image density | ○ | ○ | ○ | ○ | ○ |
| Whitening | ○ | ○ | ○ | Δ | x |
| State of semiconductive roller | Normal | Normal | Normal | Normal | Normal |

TABLE 6

| | Comparative Example 2-2 | Comparative Example 2-3 | Comparative Example 2-4 | Comparative Example 2-5 | Comparative Example 2-6 |
|---|---|---|---|---|---|
| | Parts by mass | | | | |
| Paraffin oil | 50 | 50 | 50 | 40 | 40 |
| Foaming agent | 2 | 8 | 6 | 4 | 6 |
| Foaming assisting agent | 2 | 2 | 2 | 2 | 2 |
| Outer diameter $D_1$ (mm) of inner layer | 8.9 | 9.5 | 9.6 | 9.16 | 8.6 |
| Inner diameter $D_2$ (mm) of outer layer | 8.7 | 9.3 | 9.1 | 9.1 | 8.5 |
| Wall thickness T (μm) of tube | 400 | 100 | 200 | 200 | 500 |
| Interference $D_1 - D_2$ (μm) | 200 | 200 | 500 | 60 | 100 |
| Asker-C hardness (degrees) | 65 | 25 | 55 | 58 | 62 |
| Concavities | Present | Present | Present | Present | Present |
| Image density | x | — | — | — | x |
| Whitening | ○ | — | — | — | ○ |
| State of semiconductive roller | Normal | Outer layer displaced | Outer layer broken | Outer layer displaced | Normal |

The results for Examples 2-1 to 2-9 and Comparative Example 2-1 shown in Tables 4 to 6 indicate that, where the semiconductive roller has a double layer structure including a porous inner layer and an outer layer of a tube and has a multiplicity of concavities formed in circumferentially and axially overlapping relation in the outer peripheral surface thereof, the whitening can be advantageously suppressed which may otherwise occur due to the adhesion and the accumulation of the external additives on the outer peripheral surface.

The results for Examples 2-1 to 2-9 and Comparative Examples 2-2, 2-3 and indicate that the semiconductive roller of the double layer structure is required to have an overall Asker-C hardness of not less than 30 degrees and not greater than 60 degrees in order to provide the aforementioned effects without the displacement of the outer layer and the whitening.

The results for Examples 2-1 to 2-9 and Comparative Examples 2-4 to 2-6 indicate that the tube for the outer layer is required to have a wall thickness T of not less than 100 μm and not greater than 400 μm and the interference represented by the difference $D_1$-$D_2$ between the outer diameter $D_1$ of the inner layer and the inner diameter $D_2$ of the tube is required to be not less than 100 μm and not greater than 400 μm for production of a semiconductive roller free from the breakage and the displacement of the outer layer and excellent in the aforementioned effects.

The results for Examples 2-1 to 2-9 indicate that the overall Asker-C hardness is preferably not less than 45 degrees and not greater than 50 degrees for further improvement of the aforementioned effects and hence the proportion of the paraffin oil is preferably not less than 20 parts by mass and not greater than 100 parts by mass, particularly preferably not less than 40 parts by mass and not greater than 60 parts by mass, based on 100 parts by mass of the overall rubber component.

The results for Examples 2-8 and 2-9 indicate that, where the adjacent concavities are connected to each other with a continuous curved surface, the whitening due to the adhesion and the accumulation of the external additives on the outer peripheral surface can be more advantageously suppressed.

Example 3-1

A semiconductive roller 6 was produced in substantially the same manner as in Examples 1-1, except that the outer peripheral surface 1 was axially scanned with a laser beam so as to be linearly irradiated to a predetermined width, whereby a plurality of concavities 2 were formed in circumferentially parallel relation as each axially extending along the entire length of the semiconductive roller as shown in FIGS. 9 and 10.

The concavities 2 each had a width of 80 μm and a depth of 20 μm.

The laser-processed outer peripheral surface 1 had a three-dimensional surface geometry such that the adjacent concavities 2 were connected to each other with continuous curved surfaces as shown in FIG. 9.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 37.8 μm, and a developed interfacial area ratio Sdr was 3.9 with respect to a definition area of 50000 $\mu m^2$.

Example 3-2

Figure 19:
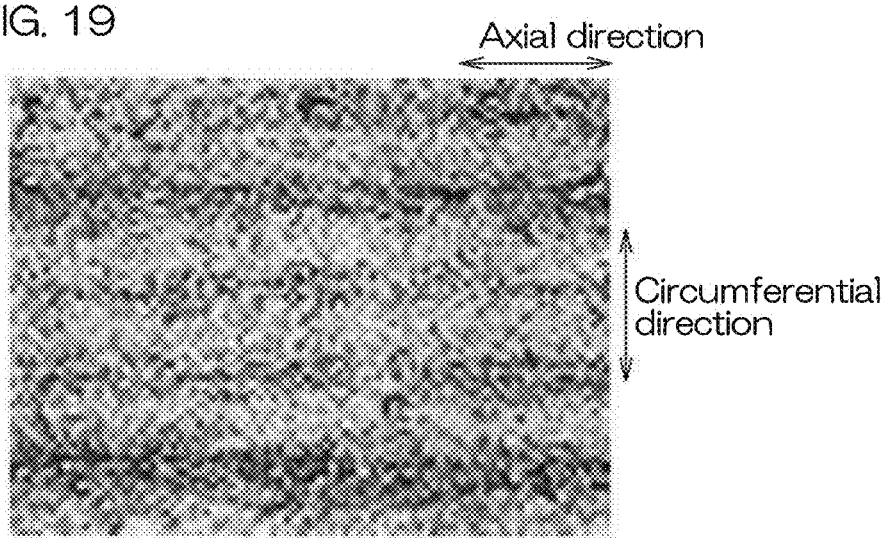
FIG. 19 is an actual microscopic photograph showing a part of an outer peripheral surface of a semiconductive roller of an inventive example on an enlarged scale.

A semiconductive roller 6 was produced in substantially the same manner as in Example 3-1, except that a plurality of concavities 2 each having a width of 40 μm and a depth of 5 μm were formed in circumferentially parallel relation as each extending axially along the entire length of the semiconductive roller as shown in FIG. 19 by controlling the scanning width and the intensity of the laser beam.

The laser-processed outer peripheral surface 1 had a three-dimensional surface geometry such that the adjacent concavities 2 were connected to each other with continuous curved surfaces as shown in FIG. 19.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 19.8 μm, and a developed interfacial area ratio Sdr was 1.2 with respect to a definition area of 50000 $\mu m^2$.

Example 3-3

A semiconductive roller 6 was produced in substantially the same manner as in Examples 3-1, except that the outer peripheral surface 1 was circumferentially scanned with a laser beam so as to be linearly irradiated to a predetermined width, whereby a plurality of concavities 2 were formed in axially parallel relation as each extending along the entire circumference of the semiconductive roller as shown in FIGS. 13 and 14.

The concavities 2 each had a width of 40 μm and a depth of 5 μm

The laser-processed outer peripheral surface 1 had a three-dimensional surface geometry such that the adjacent concavities 2 were connected to each other with continuous curved surfaces as shown in FIG. 13.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 11.5 μm, and a developed interfacial area ratio Sdr was 0.4 with respect to a definition area of 50000 $\mu m^2$.

Example 3-4

Figure 20:
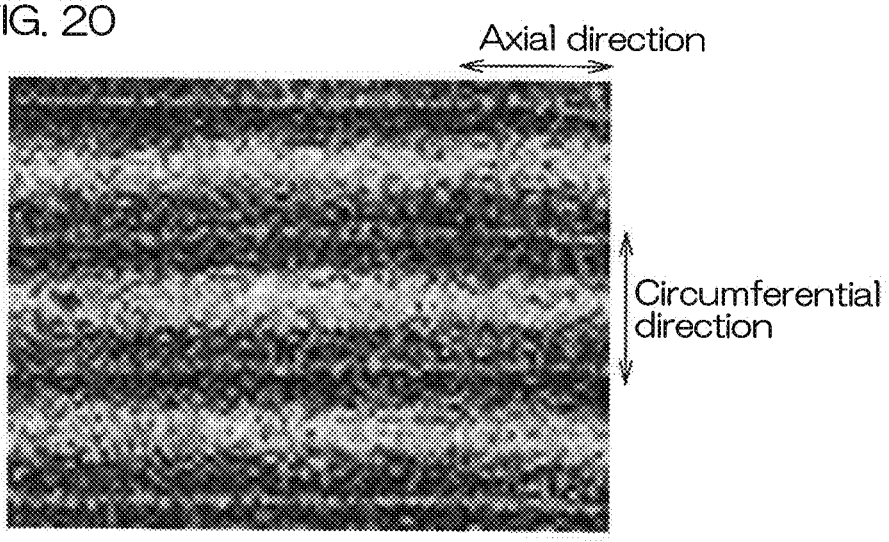
FIG. 20 is an actual microscopic photograph showing a part of an outer peripheral surface of a semiconductive roller of another inventive example on an enlarged scale.

A semiconductive roller 6 was produced in substantially the same manner as in Example 3-1, except that a plurality of concavities 2 each having a width of 60 μm and a depth of 15 μm were formed in circumferentially parallel relation as each extending axially along the entire length of the semiconductive roller as shown in FIG. 20 by controlling the scanning width and the intensity of the laser beam.

The laser-processed outer peripheral surface 1 had a three-dimensional surface geometry such that the adjacent concavities 2 were connected to each other with continuous curved surfaces as shown in FIG. 20.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 21.9 μm, and a developed interfacial area ratio Sdr was 3.8 with respect to a definition area of 50000 $\mu m^2$ Example 3-5

Figure 21:
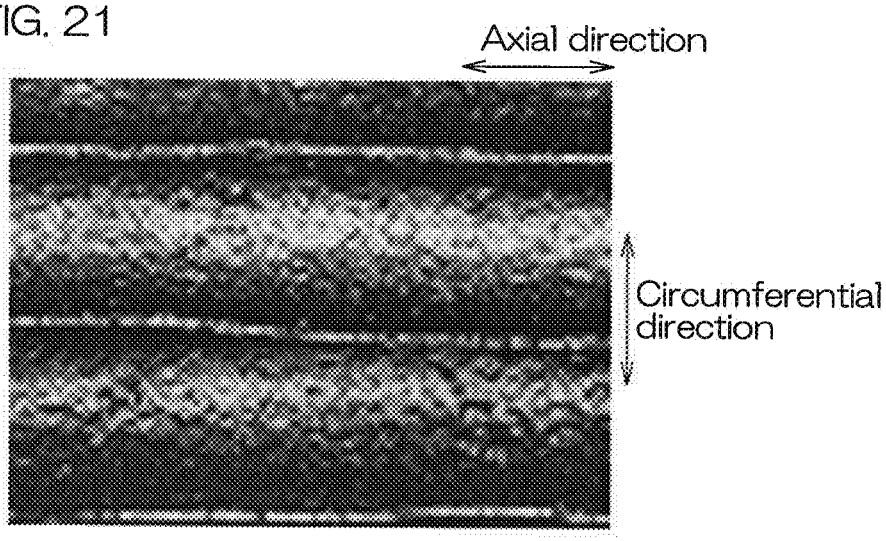
FIG. 21 is an actual microscopic photograph showing a part of an outer peripheral surface of a semiconductive roller of further another inventive example on an enlarged scale.

A semiconductive roller 6 was produced in substantially the same manner as in Example 3-1, except that a plurality of concavities 2 each having a width of 80 μm and a depth of 60 μm were formed in circumferentially parallel relation as each extending axially along the entire length of the semiconductive roller as shown in FIG. 21 by controlling the scanning width and the intensity of the laser beam.

The laser-processed outer peripheral surface 1 had a three-dimensional surface geometry such that the adjacent concavities 2 were connected to each other with continuous curved surfaces as shown in FIG. 21.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 90.3 μm, and a developed interfacial area ratio Sdr was 24 with respect to a definition area of 50000 $\mu m^2$.

Example 3-6

Figure 22:
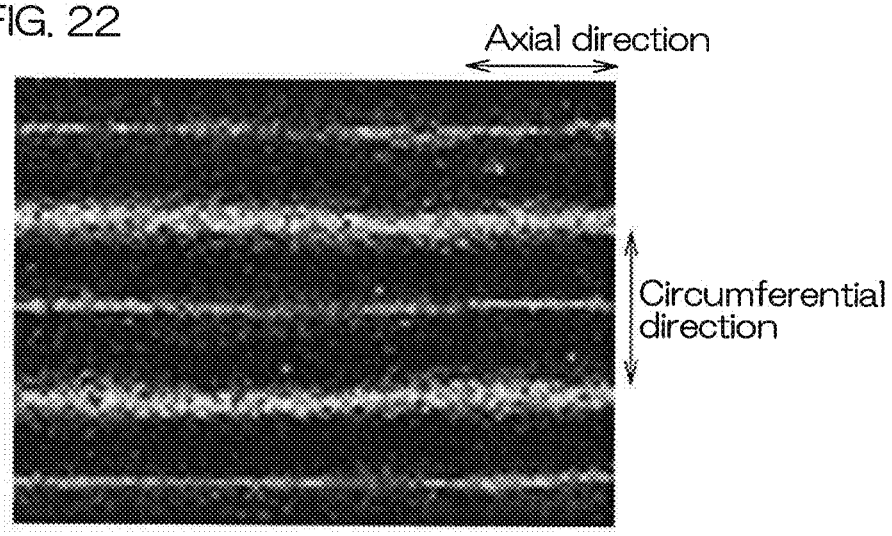
FIG. 22 is an actual microscopic photograph showing a part of an outer peripheral surface of a semiconductive roller of still another inventive example on an enlarged scale.

A semiconductive roller 6 was produced in substantially the same manner as in Example 3-1, except that a plurality of concavities 2 each having a width of 110 μm and a depth of 40 μm were formed in circumferentially parallel relation as each extending axially along the entire length of the semiconductive roller as shown in FIG. 22 by controlling the scanning width and the intensity of the laser beam.

The laser-processed outer peripheral surface 1 had a three-dimensional surface geometry such that the adjacent concavities 2 were connected to each other with continuous curved surfaces as shown in FIG. 22.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 58.0 μm, and a developed interfacial area ratio Sdr was 11 with respect to a definition area of 50000 $\mu m^2$.

Example 3-7

A semiconductive roller 6 was produced in substantially the same manner as in Example 3-1, except that the outer peripheral surface 1 was axially and circumferentially scanned with a laser beam so as to be linearly irradiated to a predetermined width, whereby a plurality of concavities 2 were formed in axially parallel and non-overlapping spaded relation as each extending along the entire circumference of the semiconductive roller and a plurality of concavities 2 were formed in circumferentially parallel and non-overlapping spaced relation as each extending axially along the entire length of the semiconductive roller as shown in FIGS. 11 and 12.

Thus, the concavities 2 were arranged in a matrix array, and generally rectangular regions defined between the thus arranged concavities 2 were left unprocessed with polishing marks remaining therein. Sharp edges were present along boundaries between the unprocessed regions and the con cavities 2.

The surface texture of the outer peripheral surface 1 of the semiconductive roller 6 thus produced was analyzed by means of a geometry analyzing laser microscope (VK-X150/160 available from Keyence Corporation). As a result, the maximum height Sz of the outer peripheral surface 1 was 36.0 μm, and a developed interfacial area ratio Sdr was 4.0 with respect to a definition area of 50000 $\mu m^2$.

<Evaluation for Processing Period>

In Examples 3-1, 3-3 and 3-7, processing periods required for forming the concavities 2 in the entire outer peripheral surface 1 by the laser processing were measured. The results are shown together with the result for Example 1-1 in Table 7.

TABLE 7

| | Example 3-1 | Example 3-3 | Example 3-7 | Example 1-1 |
|---|---|---|---|---|
| Processing period (sec) | 200 | 300 | 700 | 2000 |

The results shown in Table 7 indicate that, where linear concavities 2 are formed in the outer peripheral surface 1 as extending along the entire circumference or along the entire length, the number of times of the irradiation with the laser beam and the irradiation period are significantly reduced to improve the productivity of the semiconductive roller, <Actual Machine Test>

A photoconductor unit (available from Lexmark International, Inc.) including a photoreceptor body and a charging roller constantly kept in contact with the surface of the photoreceptor body and attachable to a laser printer main body was prepared, and the semiconductive rollers produced in Examples and Comparative Examples were each incorporated as a charging roller instead of the original charging roller of the photoconductor unit.

Immediately after the photoconductor unit thus assembled was mounted in a color laser printer (CS510 available from Lexmark International, Inc.), a solid image was formed. Based on the solid image thus formed, the semiconductive roller was evaluated against image density reduction.

That is, the formed solid image was visually observed. As a result, a semiconductive roller causing image density reduction was rated as unacceptable (×), and a semiconductive roller causing slight image density reduction was rated as practically acceptable (Δ). A semiconductive roller free from the image density reduction was rated as acceptable (○).

After the photoconductor unit was mounted in the color laser printer and paper sheets were passed through the color laser printer at a rate of 2000 sheets per day for 5 days, the semiconductive roller was taken out, and evaluated against the adhesion and the accumulation of external additives on the outer peripheral surface.

That is, the outer peripheral surface of the semiconductive roller was visually observed. As a result, a semiconductive roller having an outer peripheral surface entirely whitened due to the adhesion of the external additives was rated as unacceptable (×), and a semiconductive roller having an outer peripheral surface partly whitened was rated as practically acceptable (Δ). A semiconductive roller having an outer peripheral surface free from the whitening was rated as acceptable (○).

The results are shown together with the results for Example 1-1 in Tables 8 and 9.

TABLE 8

| | Example 3-2 | Example 3-3 | Example 3-4 | Example 3-1 |
|---|---|---|---|---|
| | Concavities | | | |
| Shape | Linear | Linear | Linear | Linear |
| Direction | Axial | Circumferential | Axial | Axial |
| Width (μm) | 40 | 40 | 60 | 80 |
| Depth (μm) | 5 | 5 | 15 | 20 |
| Image density | ○ | ○ | ○ | ○ |
| Whitening | ○ | Δ | ○ | ○ |

TABLE 9

| | Example 3-5 | Example 3-6 | Example 3-7 | Example 1-1 |
|---|---|---|---|---|
| | Concavities | | | |
| Shape | Linear | Linear | Linear | Oval |
| Direction | Axial | Circumferential | Axial + Circumferential | — |
| Width (μm) | 80 | 110 | 80 | 80 |
| Depth (μm) | 60 | 40 | 20 | 20 |
| Image density | Δ | Δ | ○ | ○ |
| Whitening | ○ | ○ | ○ | ○ |

The results for Examples 3-1 to 3-7 shown in Tables 8 and 9 indicate that, where the linear concavities are provided in the outer peripheral surface 1, the semiconductive roller can advantageously suppress the adhesion and the accumulation of the external additives on the outer peripheral surface while maintaining a proper image density as in Example 1-1. As apparent from the results shown in Table 7, it is possible to significantly reduce the number of times of the laser irradiation and the irradiation period to improve the productivity of the semiconductive roller.

Further, the results for Examples 3-1 to 3-7 indicate that the linear concavities 2 preferably each have a depth of not greater than 50 μm and a width of not greater than 100 μm and are preferably formed at least axially in parallel relation in the outer peripheral surface 1 for further improvement of the aforementioned effects.

This application corresponds to Japanese Patent Application No. 2015-236638 filed in the Japan Patent Office on Dec. 3, 2015 and Japanese Patent Application No. 2016-075333 filed in the Japan Patent Office on Apr. 4, 2016, the disclosures of which are incorporated herein by reference in their entireties.

What is claimed is:

1. A semiconductive roller comprising a tubular main body formed of a semiconductive rubber composition, wherein the main body has a multiplicity of concavities provided in an outer peripheral surface thereof in at least one of circumferentially overlapping relation and axially overlapping relation, wherein the concavities are each rounded toward a center thereof from an outer periphery thereof.

2. The semiconductive roller according to claim 1, wherein the concavities each have a depth of not less than 0.5 μm and not greater than 100 μm.

3. The semiconductive roller according to claim 2, wherein the multiplicity of concavities are arranged circumferentially and axially in rows.

4. The semiconductive roller according to claim 3, wherein at least some of the multiplicity of concavities have a length such as to extend across a plurality of circumferential or axial rows.

5. The semiconductive roller according to claim 4, wherein the concavities each have a depth of not less than 0.5 μm and not greater than 50 μm, a width of not greater than 100 μm, and the outer peripheral surface has a developed interfacial area ratio Sdr of not greater than 5.

6. The semiconductive roller according to claim 2, wherein adjacent ones of the concavities are connected to each other with a continuous curved surface.

7. The semiconductive roller according to claim 1, wherein the concavities provided in the outer peripheral surface are each defined as a region having a load area ratio of greater than 10% on a volume parameter graph (load curve) specified in International Organization for Standardization ISO 25178-2:2012, and a region (not formed with the concavities) having a load area ratio of not greater than 10% is defined as a projection.

8. The semiconductive roller according to claim 1, wherein the outer peripheral surface is such that a maximum height Sz specified in International Organization for Standardization ISO 25178-2:2012 is not less than 0.5 μm and not greater than 30 μm, and a developed interfacial area ratio Sdr specified in International Organization for Standardization ISO 25178-2:2012 is not greater than 5.

9. The semiconductive roller according to claim 1, wherein the main body is a nonporous single-layer body formed of a semiconductive rubber composition.

10. The semiconductive roller according to claim 9, wherein the main body has an oxide film provided in the outer peripheral surface thereof.

11. The semiconductive roller according to claim 1, wherein the main body includes a porous tubular inner layer formed of a semiconductive rubber composition, and an outer layer of a seamless semiconductive thermoplastic elastomer tube provided on an outer periphery of the inner layer, wherein the main body has an overall Asker-C hardness of not less than 30 degrees and not greater than 60 degrees, wherein the multiplicity of concavities are provided in an outer peripheral surface of the outer layer.

12. A semiconductive roller production method, comprising the steps of:

forming a tubular main body of a semiconductive rubber composition; and forming a multiplicity of concavities in an outer peripheral surface of the formed tubular main body in at least one of circumferentially overlapping relation and axially overlapping relation by a laser processing method, the concavities being each rounded toward a center thereof from an outer periphery thereof.

13. The semiconductive roller production method according to claim 12, wherein the multiplicity of concavities are arranged circumferentially and axially in rows, and at least some of the multiplicity of concavities have a length such as to extend across a plurality of circumferential or axial rows.

14. The semiconductive roller production method according to claim 12, wherein the tubular main body forming step includes the steps of:

forming a porous tubular inner layer of a semiconductive rubber composition;

covering an outer periphery of the tubular inner layer with an outer layer;

wherein the step of covering the inner layer with the outer layer includes the step of preparing a semiconductive thermoplastic elastomer tube having a wall thickness T of not less than 100 μm and not greater than 400 μm, and press-inserting the tubular inner layer into the tube.

15. The semiconductive roller production method according to claim 14, wherein the inner layer has an outer diameter $D_1$ that is greater than an inner diameter $D_2$ of the tube, and an interference represented by a difference $D_1-D_2$ between the outer diameter $D_1$ and the inner diameter $D_2$ is not less than 100 μm and not greater than 400 μm in the tubular inner layer forming step.

* * * * *